US010982893B2

(12) United States Patent
Broadbent et al.

(10) Patent No.: US 10,982,893 B2
(45) **Date of Patent: *Apr. 20, 2021**

(54) ICE MAKER WITH AUTOMATIC DESCALE AND SANITIZE FEATURE

(71) Applicant: True Manufacturing Co., Inc., O'Fallon, MO (US)

(72) Inventors: John Allen Broadbent, Denver, CO (US); Paolo Moro, Milan (IT)

(73) Assignee: True Manufacturing Co., Inc., O'Fallon, MO (US)

( * ) Notice: Subject to any disclaimer, the term of this patent is extended or adjusted under 35 U.S.C. 154(b) by 78 days.

This patent is subject to a terminal disclaimer.

(21) Appl. No.: 16/399,329

(22) Filed: Apr. 30, 2019

(65) Prior Publication Data

US 2019/0257565 A1 Aug. 22, 2019

Related U.S. Application Data

(62) Division of application No. 15/085,156, filed on Mar. 30, 2016, now Pat. No. 10,317,122.

(Continued)

(51) Int. Cl.

| | |
|---|---|
| ***F25C 1/25*** | (2018.01) |
| ***B08B 9/00*** | (2006.01) |
| *B08B 9/027* | (2006.01) |

(52) U.S. Cl.

CPC ..... *F25C 1/25* (2018.01); *B08B 9/00* (2013.01); *B08B 9/027* (2013.01); *F25C 2400/12* (2013.01); *F25C 2600/02* (2013.01)

(58) Field of Classification Search

CPC ... B08B 9/00; B08B 9/027; C02F 1/50; C02F 5/08; F25C 1/25; F25C 2400/12;

(Continued)

(56) References Cited

U.S. PATENT DOCUMENTS 3,080,726 A * 3/1963 Tenniswood ..... F25C 1/06 62/138

5,458,851 A 10/1995 Schroeder et al.

(Continued)

FOREIGN PATENT DOCUMENTS

JP 2009052862 A 3/2009

KR 1020140002358 1/2014

(Continued)

OTHER PUBLICATIONS

Broadbent et al., Ice Maker With Automatic Clean and Sanitizer Feature; Mar. 7, 2014, WO2014117112A2, Whole Document (Year: 2014).*

(Continued)

*Primary Examiner* — Larry L Furdge

(74) *Attorney, Agent, or Firm* — Stinson LLP

(57) ABSTRACT

An automatic descale and sanitize process for an ice maker which requires less user intervention and time. During descaling, a main water reservoir of an ice maker sump is filled with water to a descale water level and mixes with a cleaner placed in the main water reservoir. The water/cleaner mixture is pumped through the ice maker to descale the water system and freeze plate. During sanitizing, the sump is filled with water to a sanitize water level, above the descale water level, and mixes with sanitizer placed in a sanitizer reservoir of the sump. The water/sanitizer mixture is pumped through the ice maker to sanitize the water system and freeze plate. During descaling, the sanitizer placed in the sanitizer reservoir does not come into contact with the water in the main water reservoir. After the descale and sanitize process, the ice maker can return to making ice.

21 Claims, 12 Drawing Sheets

Related U.S. Application Data

(60) Provisional application No. 62/143,293, filed on Apr. 6, 2015.

(58) Field of Classification Search
CPC .... F25C 2600/02; F25C 1/12; F25C 2400/10; F25C 2700/04; F25C 2600/04
See application file for complete search history.

(56) References Cited

U.S. PATENT DOCUMENTS

| | | | | |
|---|---|---|---|---|
| 5,477,694 | A * | 12/1995 | Black | F25C 1/12 62/137 |
| 5,586,439 | A | 12/1996 | Schlosser et al. | |
| 6,334,328 | B1 | 1/2002 | Brill | |
| 6,619,051 | B1 | 9/2003 | Kilawee et al. | |
| 7,422,684 | B1 * | 9/2008 | Davis | C02F 1/78 210/192 |
| 10,317,122 | B2 * | 6/2019 | Broadbent | B08B 9/00 |
| 2003/0131404 | A1 | 7/2003 | Kimura | |
| 2003/0221701 | A1 * | 12/2003 | Hardwicke | F01D 25/002 134/1 |
| 2004/0109799 | A1 * | 6/2004 | Kadlec | A61L 2/20 422/292 |
| 2005/0137118 | A1 * | 6/2005 | Silveri | C02F 1/008 510/514 |
| 2009/0320501 | A1 | 12/2009 | Morimoto et al. | |
| 2012/0031114 | A1 | 2/2012 | Mueller et al. | |

FOREIGN PATENT DOCUMENTS

| | | | |
|---|---|---|---|
| RU | 41577 | U1 | 11/2004 |
| WO | 2010077700 | A1 | 7/2010 |

OTHER PUBLICATIONS

International Search Report, Application No. PCT/US2014/013250, dated Aug. 28, 2014, pp. 2.
International Search Report, Application No. PCT/US2016/024906, dated Oct. 18, 2016, pp. 3.

* cited by examiner

ICE MAKER WITH AUTOMATIC DESCALE AND SANITIZE FEATURE

CROSS-REFERENCE TO RELATED APPLICATIONS

This Application is a division of U.S. patent application Ser. No. 15/085,156, filed Mar. 30, 2016 and entitled ICE MAKER WITH AUTOMATIC DESCALE AND SANITIZE FEATURE, which claims priority to U.S. Provisional Patent Application Ser. No. 62/143,293, field Apr. 6, 2015 and entitled ICE MAKER WITH AUTOMATIC DESCALE AND SANITIZE FEATURE, each of which is hereby incorporated by reference in its entirety.

FIELD OF THE INVENTION

This invention relates generally to automatic ice making machines and, more particularly, to ice making machines with an automatic descaling and sanitizing feature.

BACKGROUND OF THE INVENTION

Ice making machines, or ice makers, typically comprise a refrigeration and water system that employs a source of refrigerant flowing serially through a compressor, a condenser, a thermal expansion device, an evaporator, and a freeze plate comprising a lattice-type cube mold thermally coupled with the evaporator. Additionally, typical ice makers employ gravity water flow and ice harvest systems that are well known and in extensive use. Ice makers having such a refrigeration and water system are often disposed on top of ice storage bins, where ice that has been harvested is stored until it is needed. Such ice makers may also be of the "self-contained" type wherein the ice maker and ice storage bin are a single unit. Such ice makers have received wide acceptance and are particularly desirable for commercial installations such as restaurants, bars, motels and various beverage retailers having a high and continuous demand for fresh ice.

The ice produced by such ice makers is either consumed as a food in beverages, comes in direct contact with food, and/or comes into direct contact with beverage containers that in turn come into direct contact a with a drinker's beverage, lips, and mouth. Therefore, ice is a food product, and an ice maker is a food preparing machine. As such, sanitizing and cleaning or descaling an ice maker on a regular basis is a recommended practice.

In particular, sanitizing eliminates harmful bacteria, viruses and protozoa that thrive in a cold ice-making environment. These microscopic organisms can be either airborne or waterborne. Municipal water systems are relatively free of harmful waterborne organisms due to chlorine treatment. Water filtration can also provide protection against waterborne bacterial contamination. However, airborne organisms can still migrate to the ice maker. Bacteria, viruses, and protozoa can also adhere to moist areas on the inside of the ice maker and thrive in the cool, damp conditions. This may result in mold, algae, and slime buildup. Slime is usually a jellylike substance that is made up of algae, mold, and yeast spores that can become either airborne or waterborne. Some of these bacteria and viruses can make people ill. Accordingly, sanitizing an ice maker is an important task that should not be neglected. Various types of food-grade sanitizing agents are typically used to kill bacteria and other biologics that may be attracted to ice makers.

A different process from sanitizing an ice maker is descaling, often referred to as cleaning. Descaling an ice maker removes minerals and metals that build up in the water system and freeze plate of the ice maker and most particularly the sump used to catch and hold cooling water that falls from the freeze plate. Minerals and metals generally comprise sodium, potassium, calcium, magnesium, iron, copper, manganese, phosphorus, and zinc in amounts that vary with locale and type of water source.

As the ice maker begins to form ice on the freeze plate, minerals and metals tend to build up concentration in the sump and begin to "wash out", or fall out of solution, to form a solid build-up in the lowest portion of the water system, the sump. This is because pure water tends to freeze first. This causes the mineral and metal concentration in the unfrozen water to increase as purer liquid water is removed in the form of ice. This phenomenon is also evident when standing water freezes into an ice cube. The clearest water will tend to be at the outer edges of the cube, which freeze first, and a cloud of minerals eventually becomes trapped at the center of the cube.

Irrespective of the type of ice made by an ice maker or the method used to make the ice, a cleaner ice maker and purer water will form harder, more sanitary, and clearer ice. Many ice makers include built-in flushing and purging cycles that direct any water from the sump to a drain when a predetermined amount of water has been turned to ice. This flushing of high mineral concentration water helps to reduce mineral formation in the sump, but eventually minerals will still form in the sump and elsewhere in the water system. After a period of time, the minerals must still be removed to keep the ice clear and conditions sanitary.

When removing mineral buildup, or scale, from an ice maker, food grade acids are used to help dissolve the mineral buildup. Heavier scale deposits may require soaking in the acid solution. Manual scrubbing, scraping or wiping is also effective and sometimes necessary to remove minerals and metals from the sump and other parts of the maker.

While critical to the safe and healthy operation of ice makers, descaling and/or sanitizing of ice makers is often neglected because such maintenance is time consuming. Descaling and sanitizing requires the ice maker to be taken offline for a period of time and is therefore inconvenient. These processes also require that service personnel be present for most of the process. Since there are two separate processes, service personnel cannot start one and leave. They must remain at or near the ice maker until the descale process is complete so that they can initiate the sanitize process.

SUMMARY OF THE INVENTION

One aspect of the present invention is directed to an automatic descale and sanitize process for an ice maker which includes a descale portion and a sanitize portion. The sump includes a main water reservoir and a sanitizer reservoir. The sump of an ice maker is filled with water to different levels during these portions of the process. During the descale portion, the main water reservoir is filled with water to a descale water level and cleaner previously placed in the main water reservoir mixes with the water. This water and cleaner mixture is pumped through the water system and over the freeze plate of the ice maker to descale the water system and freeze plate. This water and cleaner mixture is then purged and rinsed from the ice maker to remove any scale or mineral build up in the ice maker. During the sanitize portion, the sump is filled with water to a sanitize water level wherein the water enters the sanitizer reservoir and mixes with any sanitizer, ideally a powdered sanitizer, previously placed therein. This water and sanitizer mixture is pumped through the water system and over the freeze plate of the ice maker to sanitize the water system and freeze plate. This water and sanitizer mixture is then purged and rinsed from the ice maker to remove any harmful bacteria and other biologics in the ice maker. The sanitizer reservoir is at a level above the descale water level. Therefore, during the descale portion of the automatic descale and sanitize process, the sanitizer that is placed in sanitizer reservoir does not come into contact with the water in the main water reservoir of the sump. Following the automatic descale and sanitize process, the ice maker can return to making ice.

Another aspect of the present invention is directed to a sump for an ice maker, the sump comprising (i) a main water reservoir formed by a first bottom and a first wall extending from the first bottom, wherein the main water reservoir is adapted to be filled with water to an ice making water level, a descale water level, and a sanitize water level above the descale level; and (ii) a sanitizer reservoir for holding a sanitizer, the sanitizer reservoir formed by a second bottom and a second wall extending from the second bottom. The sanitizer reservoir is in fluid communication with the main water reservoir, and the second bottom is at a height above the first bottom such that when the main water reservoir is filled to the sanitize water level, water enters the sanitizer reservoir and the sanitizer therein mixes with the water and can then enter into the main water reservoir.

Another aspect of the present invention is directed to a sump for an ice maker, the sump comprising: (i) a main water reservoir formed by a first bottom and a first wall extending from the first bottom, wherein the main water reservoir is adapted to be filled with water to an ice making water level, a descale water level, and a sanitize water level above the descale level; and (ii) a sanitizer reservoir hingedly connected to the first wall for holding a sanitizer, the sanitizer reservoir formed by a second bottom and a second wall extending from the second bottom, wherein the sanitizer reservoir further comprises a float. The second bottom is at a height above the first bottom such that when the sump is filled to the sanitize water level, water causes the float to rise causing the sanitizer reservoir to rotate and dump the sanitizer therein into the main water reservoir.

Another aspect of the present invention is directed to an ice maker for forming ice, the ice maker comprising a refrigeration system, a water system. The refrigeration system comprises a compressor, a condenser, an evaporator, and a freeze plate thermally coupled to the evaporator, wherein the compressor, condenser and evaporator are in fluid communication by one or more refrigerant lines. The water system supplies water to the freeze plate, and comprises a sump below the freeze plate, wherein the sump comprises a main water reservoir for holding water and a sanitizer reservoir for holding a sanitizer, a water distributor above the freeze plate, and a water pump, wherein the water pump is in fluid communication with the water distributor by a water line. The water system further comprises a water supply line and a water inlet valve in fluid communication therewith wherein the water inlet valve is adapted to supply water to the sump. The ice maker further comprises a water level sensor adapted to determine the water level in the sump and a controller adapted to control the ice maker in response to the water level in the sump measured by the water level sensor. The controller is adapted to: (a) open the water inlet valve to fill the main water reservoir with water to an ice making water level during an ice making cycle; (b) open the water inlet valve to fill the main water reservoir with water to a descale water level during a descale portion of a descale and sanitize process; and (c) open the water inlet valve to fill the main water reservoir with water to a sanitize water level during a sanitize portion of the descale and sanitize process, wherein the sanitize water level is above the descale water level, and wherein when the sanitize water level is reached the sanitizer in the sanitizer reservoir is adapted to enter the main water reservoir.

Another aspect of the present invention is directed to an ice maker for forming ice, the ice maker comprising a refrigeration system and a water system. The refrigeration system comprises a compressor, a condenser, an evaporator, and a freeze plate thermally coupled to the evaporator, wherein the compressor, condenser and evaporator are in fluid communication by one or more refrigerant lines. The water system supplies water to the freeze plate and comprises a sump having a main water reservoir below the freeze plate, a water distributor above the freeze plate, a sanitizer reservoir above the sump for holding a sanitizer, the sanitizer reservoir formed by a bottom and a wall extending from the bottom, wherein the sanitizer reservoir comprises a spring loaded door that is normally in the closed position, and a water pump, wherein the water pump is in fluid communication with the water distributor by a water line. The water system further comprises a first water inlet valve adapted to supply water to the main water reservoir and a second water inlet valve adapted to supply water to the sanitizer reservoir. The ice maker further comprises a water level sensor adapted to determine the water level in the main water reservoir and a controller adapted to control the ice maker in response to the water level in the main water reservoir measured by the water level sensor. The controller is adapted to: (a) open the first water inlet valve to fill the main water reservoir with water to an ice making water level during an ice making cycle; (b) open the first water inlet valve to fill the main water reservoir with water to a descale water level during a descale portion of a descale and sanitize process; and (c) open the second water inlet valve to fill the sanitizer reservoir with water causing the door of the sanitizer reservoir to open and deposit any sanitizer therein into the main water reservoir during a sanitize portion of the descale and sanitize process. The descale water level may be substantially equal to or greater than the ice making water level.

Yet another aspect of the present invention is directed to a method of descaling and sanitizing an ice maker. The ice maker comprises (i) a refrigeration system comprising a compressor, a condenser, an evaporator, and a freeze plate thermally coupled to the evaporator, wherein the compressor, condenser and evaporator are in fluid communication by one or more refrigerant lines; (ii) a water system for supplying water to the freeze plate, the water system comprising a sump below the freeze plate, wherein the sump comprises a main water reservoir and a sanitizer reservoir, a water distributor above the freeze plate, and a water pump, wherein the water pump is in fluid communication with the water distributor by a water line. The method comprises the steps of: (i) filling the main water reservoir of the sump with a first volume of water to a descale water level, and wherein the water mixes with a cleaner placed in the main water reservoir; (ii) pumping the water and cleaner mixture from the sump through the water system and over the freeze plate to descale the water system and the freeze plate; (iii) purging the water and cleaner mixture from the sump; (iv) rinsing the water system and freeze plate of remaining cleaner by filling the main water reservoir with a second volume of water to the descale water level, pumping the second volume of water from the sump through the water system and over the freeze plate, and purging the second volume of water and remaining cleaner from the sump; (v) filling the main water reservoir of the sump with a third volume of water to a sanitize water level, the sanitize water level being above the descale water level, and wherein the water mixes with a sanitizer placed in the sanitizer water reservoir; (vi) pumping the water and sanitizer mixture from the sump through the water system and over the freeze plate to sanitize the water system and the freeze plate; (vii) purging the water and sanitizer mixture from the sump; (viii) rinsing the water system and freeze plate of remaining sanitizer by filling the main water reservoir with a fourth volume of water to the sanitize water level, pumping the fourth volume of water from the sump through the water system and over the freeze plate, and purging the fourth volume of water and remaining sanitizer from the sump.

Yet another aspect of the present invention is directed to a method of descaling and sanitizing an ice maker. The ice maker comprises (i) a refrigeration system comprising a compressor, a condenser, an evaporator, and a freeze plate thermally coupled to the evaporator, wherein the compressor, condenser and evaporator are in fluid communication by one or more refrigerant lines; and (ii) a water system for supplying water to the freeze plate, the water system comprising a sump having a main water reservoir below the freeze plate, a water distributor above the freeze plate, a sanitizer reservoir above the sump for holding a sanitizer, the sanitizer reservoir formed by a bottom and a wall extending from the bottom, wherein the sanitizer reservoir comprises a spring loaded door that is normally in the closed position, and a water pump, wherein the water pump is in fluid communication with the water distributor by a water line, the water system further comprising a first water inlet valve adapted to supply water to the main water reservoir and a second water inlet valve adapted to supply water to the sanitizer reservoir. The method comprises: (i) filling the main water reservoir of the sump with a first volume of water to a descale water level using the first water inlet valve, and wherein the water mixes with a cleaner placed in the main water reservoir; (ii) pumping the water and cleaner mixture from the sump through the water system and over the freeze plate to descale the water system and the freeze plate; (iii) purging the water and cleaner mixture from the sump; (iv) rinsing the water system and freeze plate of remaining cleaner by filling the main water reservoir with a second volume of water to the descale water level using the first water inlet valve, pumping the second volume of water from the sump through the water system and over the freeze plate, and purging the second volume of water and remaining cleaner from the sump; (v) filling the main water reservoir of the sump with a third volume of water to a descale water level using the second water inlet valve, wherein the second water inlet valve fills the sanitizer reservoir with water causing the door of the sanitizer reservoir to open and deposit any sanitizer therein into the main water reservoir; (vi) pumping the water and sanitizer mixture from the sump through the water system and over the freeze plate to sanitize the water system and the freeze plate; (vii) purging the water and sanitizer mixture from the sump; (viii) rinsing the water system and freeze plate of remaining sanitizer by filling the main water reservoir with a fourth volume of water to the sanitize water level, pumping the fourth volume of water from the sump through the water system and over the freeze plate, and purging the fourth volume of water and remaining sanitizer from the sump.

BRIEF DESCRIPTION OF THE FIGURES

These and other features, aspects and advantages of the invention will become more fully apparent from the following detailed description, appended claims, and accompanying drawings, wherein the drawings illustrate features in accordance with exemplary embodiments of the invention, and wherein:

Like reference numerals indicate corresponding parts throughout the several views of the various drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. All numbers expressing measurements and so forth used in the specification and claims are to be understood as being modified in all instances by the term "about." It should also be noted that any references herein to front and back, right and left, top and bottom and upper and lower are intended for convenience of description, not to limit an invention disclosed herein or its components to any one positional or spatial orientation.

Figure 1:
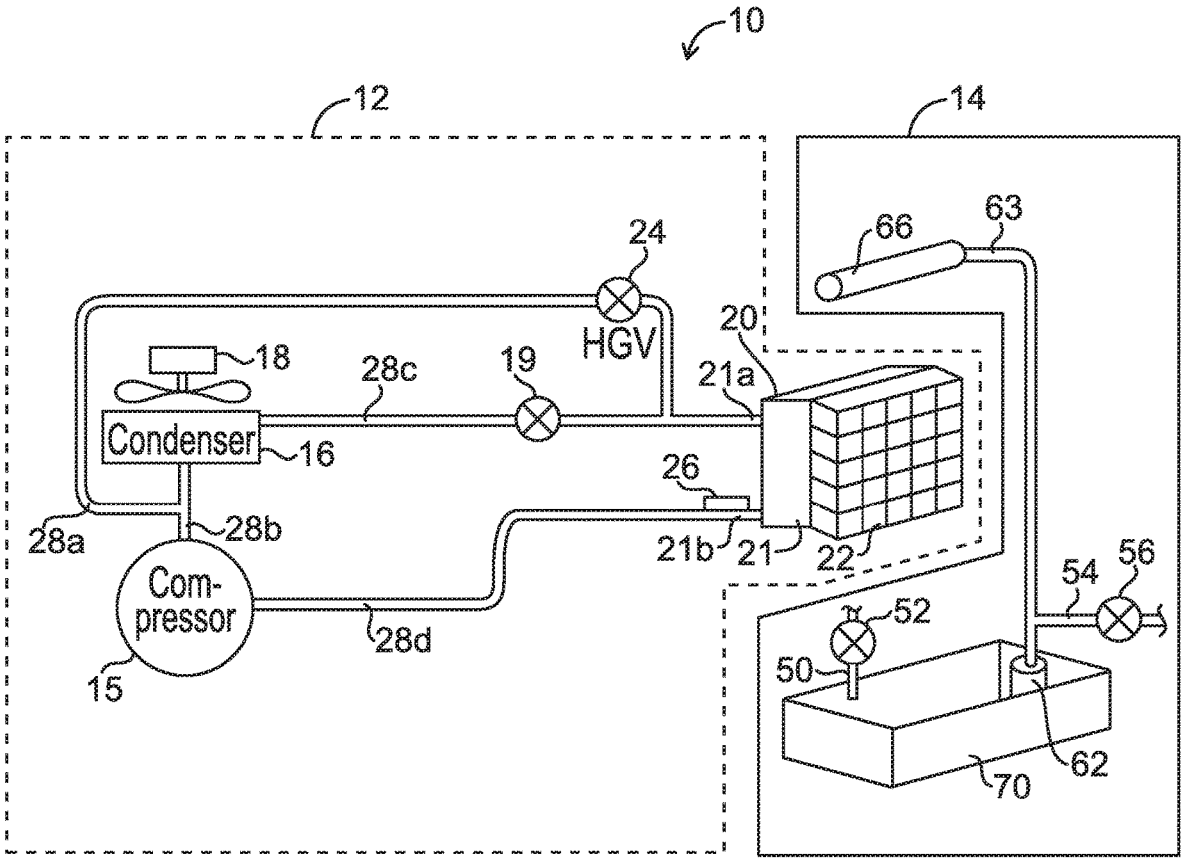
FIG. 1 is a schematic drawing of an ice maker having various components according to a first embodiment of the invention.

FIG. 1 illustrates certain principal components of one embodiment of ice maker 10 having a refrigeration system 12 and water system 14. The refrigeration system 12 of ice maker 10 includes compressor 15, condenser 16 for condensing compressed refrigerant vapor discharged from the compressor 15, refrigerant expansion device 19 for lowering the temperature and pressure of the refrigerant, ice formation device 20, and hot gas valve 24. Refrigerant expansion device 19 may include, but is not limited to, a capillary tube, a thermostatic expansion valve or an electronic expansion valve. Ice formation device 20 includes evaporator 21 and freeze plate 22 thermally coupled to evaporator 21. Evaporator 21 is constructed of serpentine tubing (not shown) as is known in the art. Freeze plate 22 contains a large number of pockets (usually in the form of a grid of cells) on its surface where water flowing over the surface can collect (see FIG. 4). Hot gas valve 24 is used to direct warm refrigerant from compressor 15 directly to evaporator 21 at inlet 21*a* to remove or harvest ice cubes from freeze plate 22 when the ice has reached the desired thickness.

Ice maker 10 also includes a temperature sensor 26 placed at the outlet 21*b* of the evaporator 21 to control refrigerant expansion device 19. If refrigerant expansion device 19 is a thermal expansion valve (TXV), then sensor 26 and expansion device 19 are connected by a capillary tube (not shown) that allows expansion device 19 to be controlled by temperature sensor 26 via the pressure of the refrigerant contained therein. If refrigerant expansion device 19 is an electronic expansion valve, then temperature sensor 26 may be in electrical, signal, and/or data communication with controller 80 which in turn may be in electrical, signal, and/or data communication with refrigerant expansion device 19 to control refrigerant expansion device 19 in response to the temperature measured by temperature sensor 26 (see FIG. 2). In various embodiments, for example, temperature sensor 26 may be in electrical, signal, and/or data communication with refrigerant expansion device 19. In other embodiments, where refrigerant expansion device 19 is an electronic expansion valve, ice maker 10 may also include a pressure sensor (not shown) placed at the outlet of the evaporator 21 to control refrigerant expansion device 19 as is known in the art. In certain embodiments that utilize a gaseous cooling medium (e.g., air) to provide condenser cooling, a condenser fan 18 may be positioned to blow the gaseous cooling medium across condenser 16. As described more fully elsewhere herein, a form of refrigerant cycles through these components via refrigerant lines 28*a*, 28*b*, 28*c*, 28*d*.

The water system 14 of ice maker 10 includes water pump 62, water line 63, water distributor 66 (e.g., manifold, pan, tube, etc.), and sump 70 located below freeze plate 22 adapted to hold water. During operation of ice maker 10, as water is pumped from sump 70 by water pump 62 through water line 63 and out of water distributor 66, the water impinges on freeze plate 22, flows over the pockets of freeze plate 22 and freezes into ice. Sump 70 may be positioned below freeze plate 22 to catch the water coming off of freeze plate 22 such that the water may be recirculated by water pump 62. Water distributor 66 may be the water distributors described in copending U.S. Patent Application Publication No. 2014/0208792 to Broadbent, filed Jan. 29, 2014, the entirety of which is incorporated herein by reference.

Water system 14 of ice maker 10 further includes water supply line 50 and water inlet valve 52 in fluid communication therewith for filling sump 70 with water from a water source (not shown), wherein some or all of the supplied water may be frozen into ice. Water system 14 of ice maker 10 further includes water discharge line 54 and discharge valve 56 (e.g., purge valve, drain valve) disposed thereon. Water and/or any contaminants remaining in sump 70 after ice has been formed may be discharged via water discharge line 54 and discharge valve 56. In various embodiments, water discharge line 54 may be in fluid communication with water line 63. Accordingly, water in sump 70 may be discharged from sump 70 by opening discharge valve 56 when water pump 62 is running.

Figure 2:
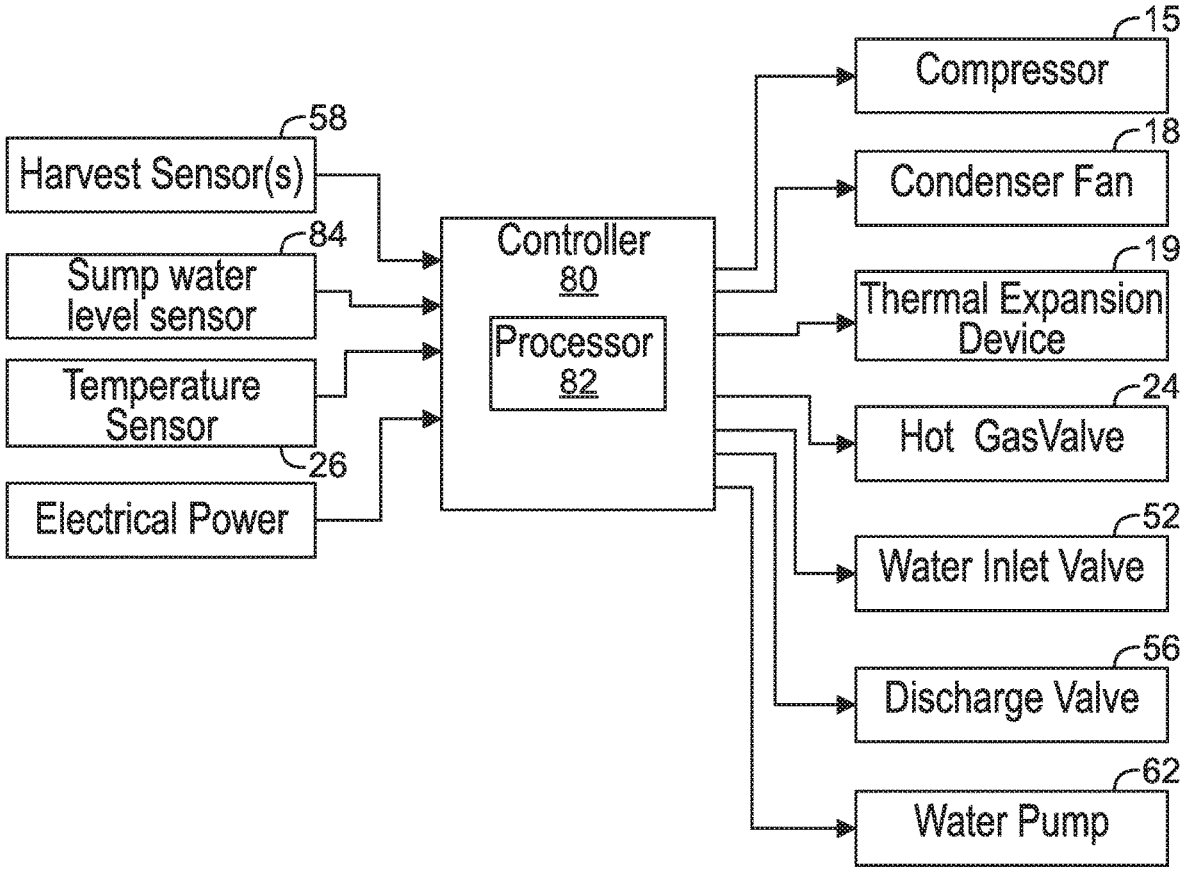
FIG. 2 is a schematic drawing of a controller for controlling the operation of the various components of an ice maker according to the first embodiment of the invention.

Referring now to FIG. 2, ice maker 10 may also include a controller 80. Controller 80 may be located remote from ice formation device 20 and sump 70. Controller 80 may include a processor 82 for controlling the operation of ice maker 10. Processor 82 of controller 80 may include a processor-readable medium storing code representing instructions to cause processor 82 to perform a process. Processor 82 may be, for example, a commercially available microprocessor, an application-specific integrated circuit (ASIC) or a combination of ASICs, which are designed to achieve one or more specific functions, or enable one or more specific devices or applications. In yet another embodiment, controller 80 may be an analog or digital circuit, or a combination of multiple circuits. Controller 80 may also include one or more memory components (not shown) for storing data in a form retrievable by controller 80. Controller 80 can store data in or retrieve data from the one or more memory components.

In various embodiments, controller 80 may also comprise input/output (I/O) components (not shown) to communicate with and/or control the various components of ice maker 10. In certain embodiments, for example controller 80 may receive inputs from a harvest sensor 58 (see FIG. 2), temperature sensor(s) 26 (see FIG. 1), a sump water level sensor 84 (see FIG. 5), an electrical power source (not shown), and/or a variety of sensors and/or switches including, but not limited to, pressure transducers, acoustic sensors, etc. In various embodiments, based on those inputs for example, controller 80 may be able to control compressor 15, condenser fan 18, refrigerant expansion device 19, hot gas valve 24, water inlet valve 52, discharge valve 56, and/or water pump 62.

Figure 4:
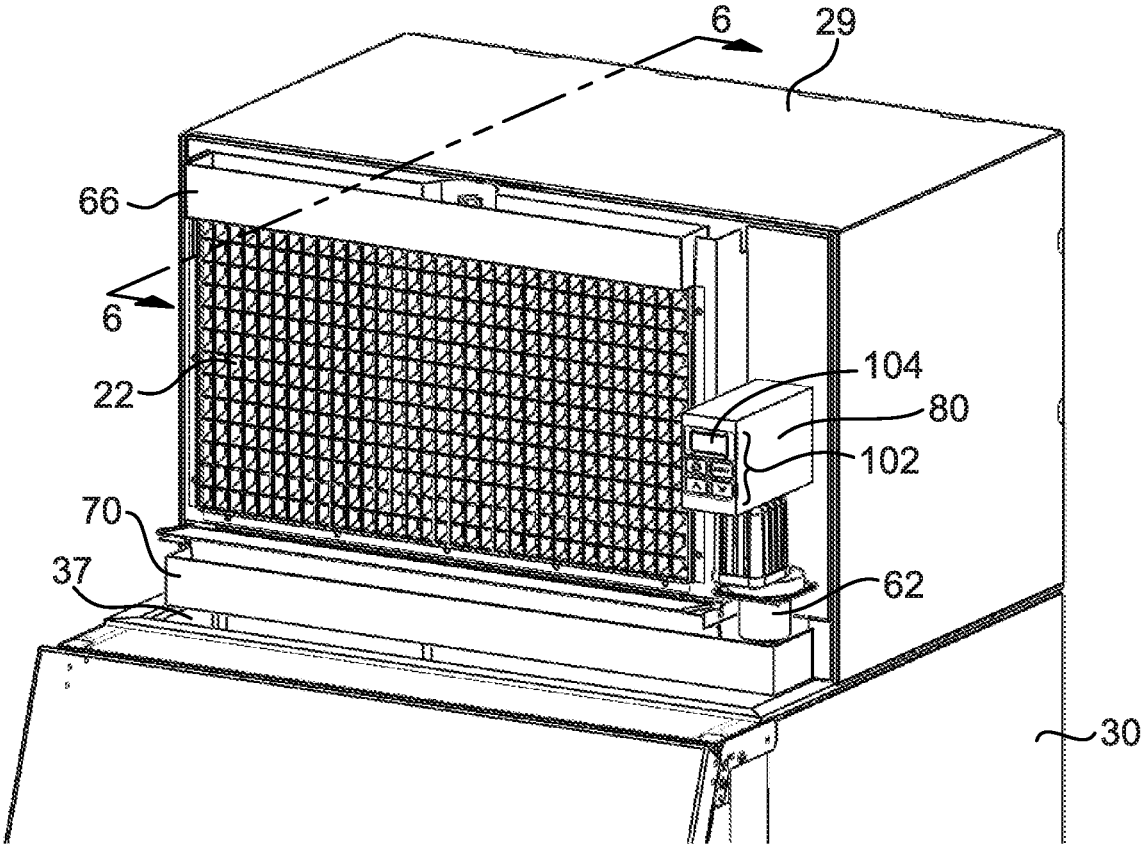
FIG. 4 is a right perspective view of an ice maker disposed within a cabinet wherein the cabinet is disposed on an ice storage bin assembly according to the first embodiment of the invention.

Referring now to FIG. 4, controller 80 may also be able to control display 104 on user control panel 102 (see FIG. 4). Display 104 may be able to display messages, including instructional messages, informational messages, and/or error or failure messages. Display 104 may be any type of display including, but not limited to, an LCD screen, one or more LEDs, etc. without departing from the scope of the disclosure. Ice maker 10 may also provide an audible alert from an sound-making device, including, but is not limited to, a speaker, a buzzer, a chime, a bell, and/or some other device capable of making a human-audible and/or non-human-audible sound.

Figure 3:
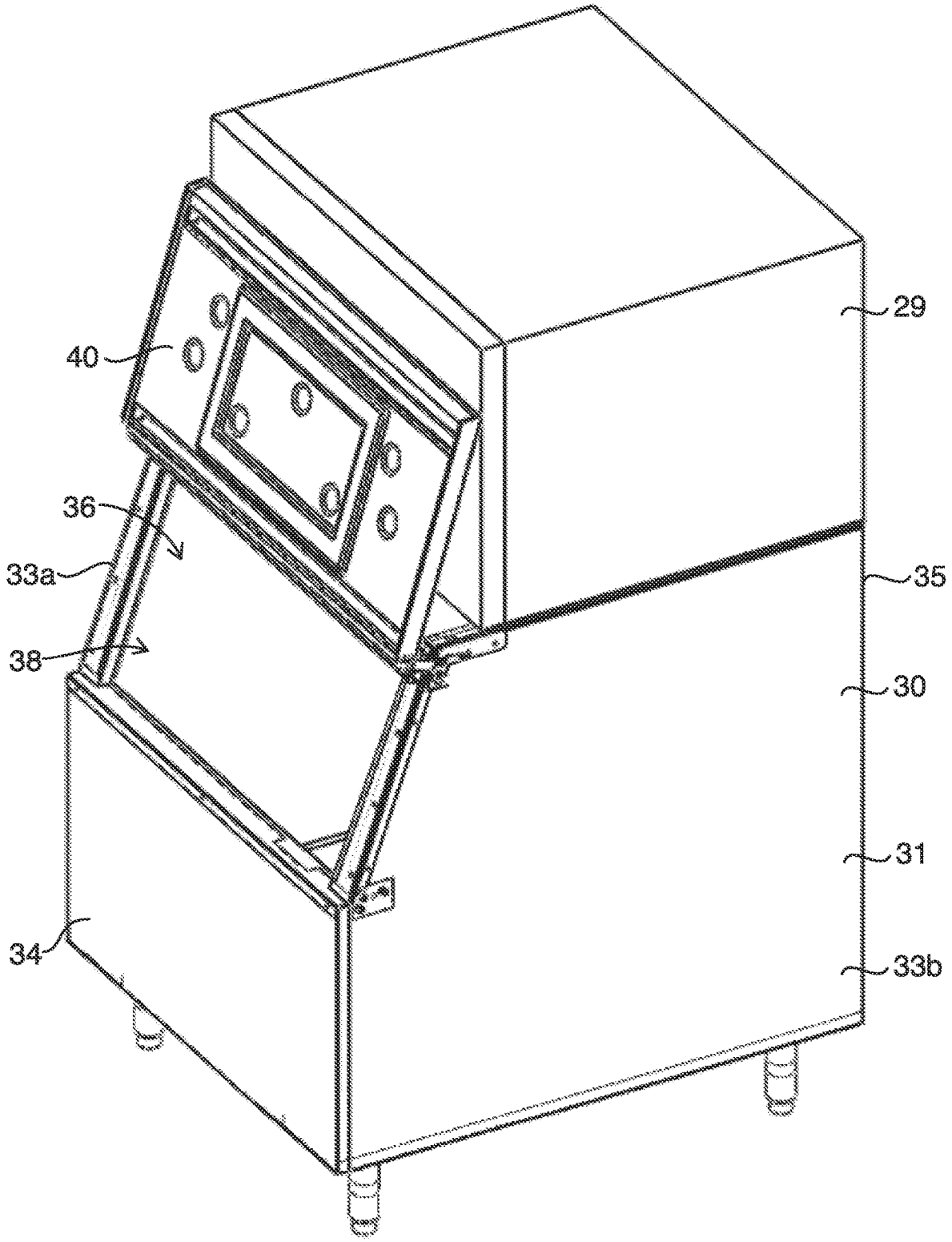
FIG. 3 is a right perspective view of an ice maker disposed within a cabinet wherein the cabinet is disposed on an ice storage bin assembly according to the first embodiment of the invention.

In many embodiments, as illustrated in FIG. 3, ice maker 10 may be disposed inside of a cabinet 29 which may be mounted on top of an ice storage bin assembly 30. Cabinet 29 may be closed by suitable fixed and removable panels to provide temperature integrity and compartmental access, as will be understood by those in the art. Ice storage bin assembly 30 includes an ice storage bin 31 having an ice hole 37 (see FIG. 4) through which ice produced by ice maker 10 falls. The ice is then stored in cavity 36 until retrieved. Ice storage bin 31 further includes an opening 38 which provides access to the cavity 36 and the ice stored therein. Cavity 36, ice hole 37 (see FIG. 4) and opening 38 are formed by a left wall 33*a*, a right wall 33*b*, a front wall 34, a back wall 35 and a bottom wall (not shown). The walls of ice storage bin 31 may be thermally insulated with various insulating materials including, but not limited to, fiberglass insulation or open- or closed-cell foam comprised, for example, of polystyrene or polyurethane, etc. in order to retard the melting of the ice stored in ice storage bin 31. A door 40 can be opened to provide access to cavity 36. In other embodiments, ice maker 10 may be disposed inside a cabinet 29 which may be mounted on top of an ice dispenser (not shown) as known in the art. For example, ice maker 10 may be mounted on an ice dispenser in a restaurant, cafeteria, hospital, hotel, or other locations where users can dispense ice into cups, buckets, or other receptacles in a self-service fashion.

Figure 5A:
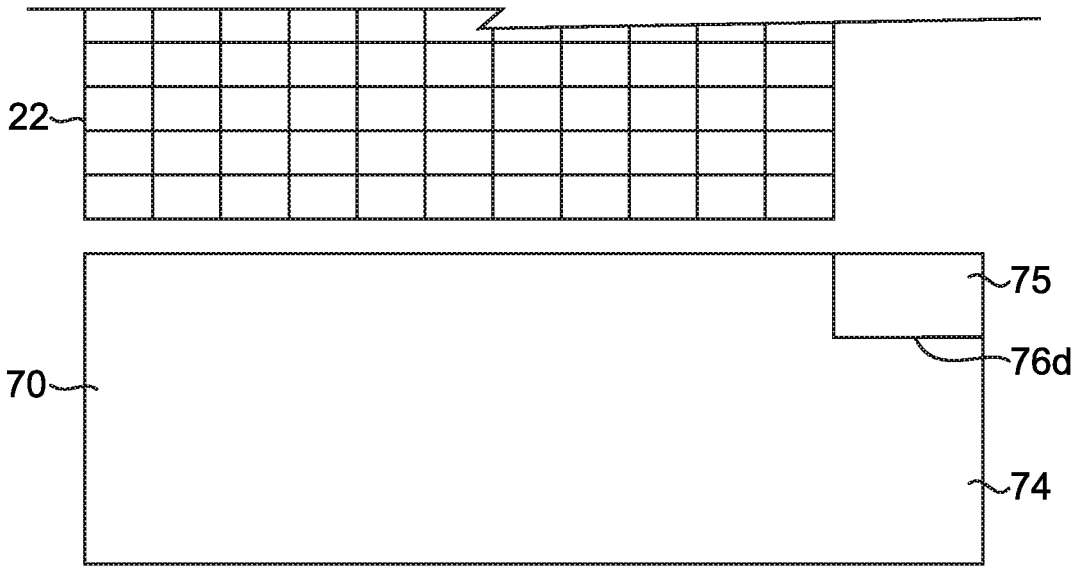
FIG. 5A is a front view of a portion of a freeze plate and a sump according to the first embodiment of the invention.
Figure 5B:
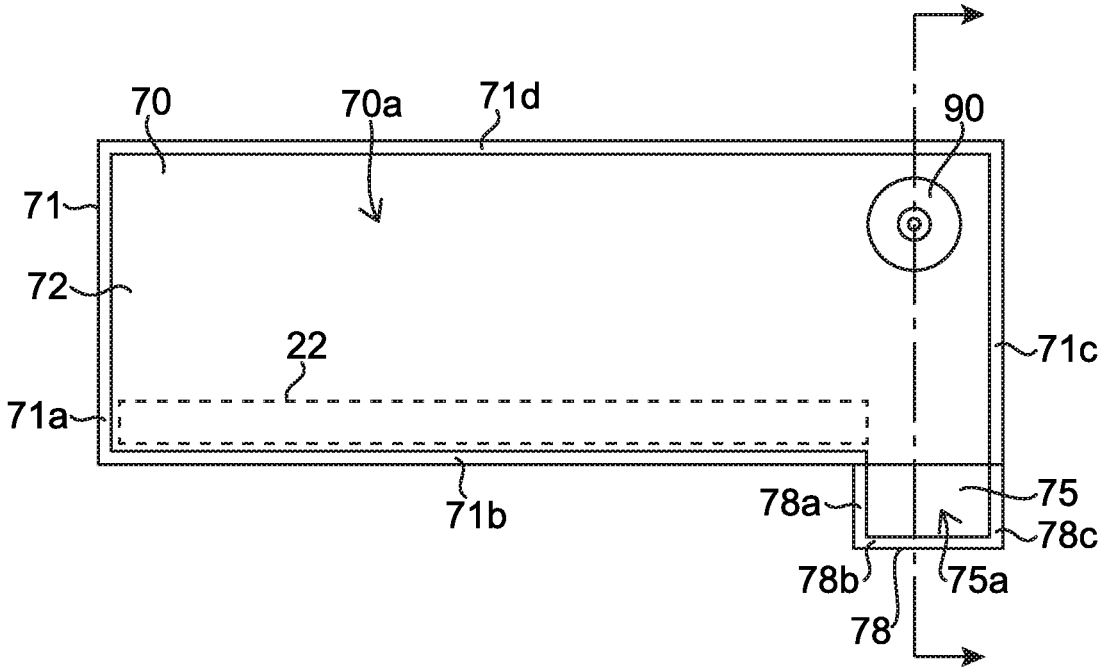
FIG. 5B is a top view of the sump according to the first embodiment of the invention.

With reference to FIGS. 5A and 5B, sump 70 used in ice maker 10 will be described in detail. As described more fully elsewhere herein, ice maker 10 uses a sanitizer solution for sanitizing ice maker 10 during a sanitizing portion of an automatic descaling and sanitizing process. Sump 70 comprises a main water reservoir 70*a* for holding water and a sanitizer reservoir 75 for holding a sanitizer. Main water reservoir 70*a* is formed by a bottom 72 and a wall 71 extending upward therefrom. Wall 71 includes left wall portion 71*a*, front wall portion 71*b*, right wall portion 71*c*, and rear wall portion 71*d*. Sanitizer reservoir 75 is shown on front wall 71*b* of sump 70 proximate right wall 71*c*. Sanitizer reservoir 75 is formed by a bottom 76 and a wall 78 extending upward therefrom. Wall 78 includes left wall portion 78*a*, front wall portion 78*b*, and right wall portion 78*c*. Sanitizer reservoir 75 is adapted to hold a sanitizer (e.g., sanitizing powder, sanitizing liquid, sanitizing tablet, sanitizing pod, etc.). Sanitizer reservoir 75 is in fluid communication with main water reservoir 70*a* of sump 70. That is sanitizer may travel from sanitizer reservoir 75 into the main water reservoir 70*a* of sump 70 during operation of sanitizing portion of descaling and sanitizing process as described more fully elsewhere herein. Placing sanitizer reservoir 75 near or on front wall 74 aids in accessibility of sanitizer reservoir 75 to users wishing to descale and/or sanitize ice maker 10. A user can easily place sanitizer into sanitizer reservoir 75 without much interference from other parts of ice maker 10. Additionally, sanitizer reservoir 75 is placed to the right such that it is out of the way of freeze plate 22 and the ice that falls from freeze plate 22 during harvest (see FIG. 5A; FIG. 5B (dashed lined box represents approximate location of freeze plate 22 with respect to sump 70)).

Figure 6:
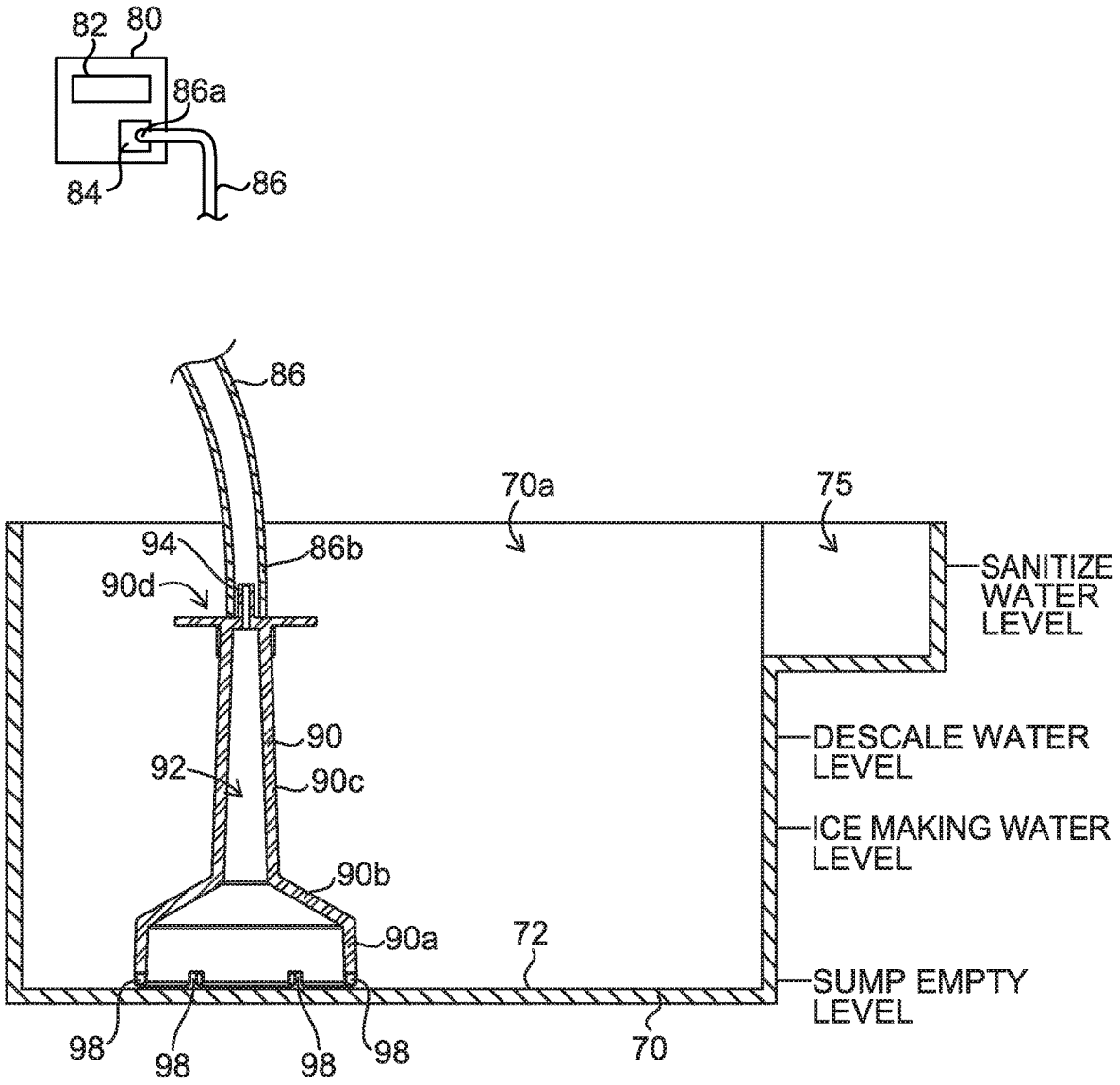
FIG. 6 is a left section view of an the sump and water level sensor according to the first embodiment of the invention.

As described in greater detail below, the automatic descale and sanitize process includes a descale portion and a sanitize portion and sump 70 is filled with water to different levels during these portions of the process. With reference now to FIG. 6, during the descale portion, sump 70 is filled with water to a descale water level and during the sanitize portion, sump 70 is filled with water to a sanitize water level. The descale water level is preferably higher than or above the normal ice making level to aid in removing scale and mineral deposits above the normal ice making level. In various embodiments, however, the descale water level may be substantially the same or the same as the normal ice making level. In other embodiments, for example, the descale water level may be less than the normal ice making level. As shown in FIGS. 5A and 6, sanitizer reservoir 75 is at a level above the descale water level. Therefore, while the ice maker 10 is operating in the descale portion of the automatic descale and sanitize process, the sanitizer that is placed in sanitizer reservoir does not come into contact with the water in sump 70. As described more fully below, when the water level in sump 70 is at the sanitize water level, the sanitizer in sanitizer reservoir 75 mixes with the water in sump 70 to sanitize water system 14 and freeze plate 22.

To measure the water level in sump 70, ice maker 10 includes a water level measurement system also shown in FIG. 6. The water level measurements system can measure two water levels (i.e., the descale water level and the sanitize water level) in sump 70 at or above the normal "full" or ice making water level in sump 70. The water level measurement system includes air fitting 90 disposed in sump 70, pneumatic tube 86 in fluid communication with air fitting 90, and controller 80. Controller 80 may also include, or be coupled to, air pressure sensor 84, which may be used to detect the water pressure proximate bottom 72 of sump 70 wherein the water pressure proximate bottom 72 of sump 70 can be correlated to the water level in sump 70. The water level in sump 70 may be correlated to the thickness of ice on freeze plate 22. Using the output from air pressure sensor 84, processor 82 can determine the water level in sump 70. Thus controller can determine a sump empty level, a harvest level, an ice making level, as well as a descaling level and sanitizing level. As shown in FIG. 6, the descaling level and sanitizing level are above the normal ice making level. During the descaling and sanitizing process, water in the sump will be raised to the descaling level and then the sanitizing level to descale and sanitize ice maker 10. During normal ice making of ice maker 10, air pressure sensor 84 also allows processor 82 to determine the appropriate time at which to initiate an ice harvest cycle, control the fill and purge functions, and to detect any failure modes of components of the water systems of ice maker 10.

In certain embodiments, air pressure sensor 84 may include a piezoresistive transducer comprising a monolithic silicon pressure sensor. The transducer may provide an analog signal to controller 80 with analog to digital (A/D) inputs. Air pressure sensor 84 may use a strain gauge to provide an output signal that is proportional to the applied pressure of water within sump 70. In certain embodiments, air pressure sensor 84 may be a low-cost, high-reliability air pressure transducer, such as part number MPXV5004 from Freescale Semiconductor of Austin, Tex. In other embodiments, controller 80 may also include, or be coupled to, any commercially available device for measuring water level in sump 70 in addition to or in replacement of air pressure sensor 84.

With continued reference to FIG. 6, air pressure sensor 84 may be connected to sump 70 by pneumatic tube 86 having a proximal end 86*a* and a distal end 86*b*. Proximal end 86*a* of pneumatic tube 86 is connected to air pressure sensor 84 and distal end 86*b* of pneumatic tube 86 is connected to and in fluid communication with air fitting 90. Air fitting 90 may be positioned in sump 70 and includes base portion 90*a*, first portion 90*b*, second portion 90*c*, and top portion 90*d* all in fluid communication with the water proximate bottom 72 of sump 70. Base portion 90*a*, first portion 90*b*, second portion

90*c*, and top portion 90*d* of air fitting 90 define a chamber 92 in which air may be trapped. One or more openings 98 surround the perimeter of base portion 90*a* allowing the water proximate bottom 72 of sump 70 to be in fluid communication with the air in chamber 92 of air fitting 90. As the water level in sump 70 increases, the pressure of the water proximate bottom 72 of sump 70 is communicated to the air in chamber 92 through the one or more openings 98 of air fitting 90. The air pressure inside chamber 92 increases and this pressure increase is communicated via air through pneumatic tube 86 to air pressure sensor 84. Controller 80 can thus determine the water level in sump 70. Additionally, as the water level in sump 70 decreases, the pressure in chamber 92 also decreases. This pressure decrease is communicated via air through pneumatic tube 86 to air pressure sensor 84. Controller 80 can thus determine the water level in the sump.

Base portion 90*a* of air fitting 90 may be substantially circular and may have a large diameter which may assist in reducing or eliminating capillary action of water inside chamber 92. First portion 90*b* may be substantially conical in shape and accordingly transition between the large diameter of base portion 90*a* to the smaller diameter of second portion 90*c*. Second portion 90*c* may taper from first portion 90*b* to top portion 90*d*. Disposed proximate top portion 90*d* may be a connector 94 to which distal end 86*b* of pneumatic tube 86 is connected. Connector 94 may be any type of pneumatic tubing connector known in the art, including, but not limited to, a barb, a nipple, etc.

In addition to the components described above, ice maker 10 may have other conventional components not described herein without departing from the scope of the invention.

Having described each of the individual components of one embodiment of ice maker 10, the manner in which the components interact and operate in various embodiments may now be described in reference again to FIG. 1. During operation of ice maker 10 in an ice making cycle, compressor 15 receives low-pressure, substantially gaseous refrigerant from evaporator 21 through suction line 28*d*, pressurizes the refrigerant, and discharges high-pressure, substantially gaseous refrigerant through discharge line 28*b* to condenser 16. In condenser 16, heat is removed from the refrigerant, causing the substantially gaseous refrigerant to condense into a substantially liquid refrigerant. The substantially liquid refrigerant may include some gas such that the refrigerant is a liquid-gas mixture.

After exiting condenser 16, the high-pressure, substantially liquid refrigerant is routed through liquid line 28*c* to refrigerant expansion device 19, which reduces the pressure of the substantially liquid refrigerant for introduction into evaporator 21 at inlet 21*a*. As the low-pressure expanded refrigerant is passed through tubing of evaporator 21, the refrigerant absorbs heat from the tubes contained within evaporator 21 and vaporizes as the refrigerant passes through the tubes. Low-pressure, substantially gaseous refrigerant is discharged from outlet 21*b* of evaporator 21 through suction line 28*d*, and is reintroduced into the inlet of compressor 15.

In certain embodiments of the invention, at the start of the ice making cycle, a water fill valve 52 is turned on to supply a mass of water to sump 70 and water pump 62 is turned on. The ice maker will freeze some or all of the mass of water into ice. After the desired mass of water is supplied to sump 70, the water fill valve may be closed. Compressor 15 is turned on to begin the flow of refrigerant through refrigeration system 12. Water pump 62 circulates the water over freeze plate 22 via water line 63 and water distributor 66. The water that is supplied by water pump 62 then begins to cool as it contacts freeze plate 22, returns to water sump 70 below freeze plate 22 and is recirculated by water pump 62 to freeze plate 22. Once the water is sufficiently cold, water flowing across freeze plate 22 starts forming ice cubes.

After the ice cubes are formed such that the desired ice cube thickness is reached, water pump 62 is turned off and the harvest portion of the ice making cycle is initiated by opening hot gas valve 24. This allows warm, high-pressure gas from compressor 15 to flow through hot gas bypass line 28*a* to enter evaporator 21 at inlet 21*a*. The warm refrigerant flows through the serpentine tubing of evaporator 21 and a heat transfer occurs between the warm refrigerant and the evaporator 21. This heat transfer warms evaporator 21, freeze plate 22, and the ice formed in freeze plate 22. This results in melting of the formed ice to a degree such that the ice may be released from freeze plate 22 and falls into ice storage bin 31 where the ice can be temporarily stored and later retrieved.

As described above, after a period of time of making ice, ice maker 10 must be descaled and sanitized. Now with reference to FIGS. 7 and 8, a method of automatically descaling and sanitizing ice maker 10 is described in detail. At step 700, the automatic descale and sanitize process is started. Preferably, a user presses a button (e.g., labeled "clean") on a control panel of ice maker 10 to initiate the process. Once the user presses the "clean" button, controller 80 receives a signal to start the descale and sanitize process. Alternative to pressing a button on ice maker 10, the user may press or select a "clean" button on remote device such as a computer and/or portable electronic device (e.g., laptop, smartphone, tablet, etc.). Therefore, the signal to start the descale and sanitize process may be sent to controller 80 from a remote location.

At step 702, after receiving the indication to start the descale and sanitize process, controller 80 causes ice maker 10 to perform a harvest cycle to harvest any ice in freeze plate 22. After the harvest cycle is complete, ice maker 10 indicates to user to add cleaner to main water reservoir 70*a* of sump 70 and sanitizer to sanitizer reservoir 75 at step 704. The indication to the user to add cleaner to main water reservoir 70*a* of sump 70 and sanitizer to sanitizer reservoir 75 may be an audible sound (e.g., a beep, a bell, a ring, etc.) emitted from the control panel 102 of ice maker 10. In addition to or alternative to the audible sound, a message may be displayed on display 104 of control panel 102 indicating that the user should add cleaner to main water reservoir 70*a* of sump 70 and sanitizer to sanitizer reservoir 75. In various embodiments, controller 80 may send a signal or information to remote device such as a computer and/or portable electronic device (e.g., laptop, smartphone, tablet, etc.) which causes the remote device to audibly and/or visually indicate to the user to add cleaner to main water reservoir 70*a* of sump 70 and sanitizer to sanitizer reservoir 75. Specifically, for example, a smartphone with an application for controlling ice maker 10 may receive such signal or information from controller 80 and may play a sound through the speaker(s) of the smartphone and/or display a message on the display of the smartphone.

At step 706, controller 80 may then pause a predetermined amount of time ($t_{wait}$) from about 30 seconds to about 90 seconds (e.g., about 30 seconds, about 45 seconds, about 60 seconds, about 75 seconds, about 90 seconds) to allow the user to add cleaner to main water reservoir 70*a* of sump 70 and sanitizer to sanitizer reservoir 75 at step 704. The cleaner is added directly to main water reservoir 70*a* of sump 70. Cleaner is preferably a food-safe acid or acid-based cleaner such as nitric acid; however, any type of cleaner known in the art for cleaning ice makers may be used. Sanitizer is added to sanitizer reservoir 75 described above with reference to FIGS. 5A and 5B. Sanitizer is preferably a food-safe powdered sanitizer such as Sani-Pure® sold by Urnex Brands, Inc. of Elmsford, N.Y.; however, any type of powered, solid, tablet, and/or pod food-safe sanitizer known in the art for sanitizing ice makers or food equipment may be used. Alternatively, controller 80 may pause until user indicates to controller 80 that the user has added cleaner to main water reservoir 70*a* of sump 70 and sanitizer to sanitizer reservoir 75. That is after the user has added the cleaner and sanitizer, the user may press a button on control panel 104 of ice maker 10 or on a remote device which signals to controller 80 to proceed with the automatic descale and sanitize process. Accordingly, controller 80 may then proceed with automatic clean and sanitize process after receiving this signal. After the user has added the cleaner and sanitizer to main water reservoir 70*a* and sanitizer reservoir 75, respectively, the user can leave the ice maker 10 to carry out the automatic descale and sanitizer process unattended. This is an advantage over typical ice makers that require a user to remain at or near the ice maker to add sanitizer after the descale portion is complete. Therefore, ice maker 10 requires less user intervention and time and therefore may result in an increased frequency of being descaled and sanitized as compared to typical ice makers. If the operator, lessee, and/or owner of ice maker 10 is paying service personnel to perform the cleaning, this process will cost less since it can be accomplished in less time and/or without the service personnel required to be present for the entire process.

When descaling and sanitizing ice maker 10, the descaling portion of the process should be done before the sanitizing portion of the process. Otherwise the sanitizing process will sanitize the outside of the mineral deposits, then those deposits will be removed by the descaling step, exposing the un-sanitized surfaces beneath the mineral deposits. By descaling first, the sanitizing step will sanitize the underlying surfaces, not the surfaces that will be removed by descaling. Furthermore, generally, descaling and sanitizing cannot be done at the same time because the chemicals used for each are not compatible and their combination can generate noxious and dangerous gases.

At step 708, controller 80 opens water supply valve 52 to supply water to main water reservoir 70*a* of sump 70. The water pumped into main water reservoir 70*a* of sump 70 then mixes with cleaner that was added to the sump by the user. Water supply valve 52 is kept open, supplying water to main water reservoir 70*a* of sump 70, until the water level in main water reservoir 70*a* of sump 70 reaches the descale water level as measured by sump water level sensor 84. Once the descale water level is reached, controller 80 closes water supply valve 52. During normal ice making, water may splash up and may land on portions of the sump 70 above the normal water level. This may leave mineral deposits on various portions of the sump. Therefore, as shown in FIG. 6, the descale water level is preferably higher than or above the normal ice making level. Descaling may be done at this higher water level so that any mineral deposits that are above the normal ice making water level are removed during the descaling portion of the automatic descaling and sanitizing process.

The descale water level is preferably high enough in main water reservoir 70*a* such that when water pump 62 turns on during subsequent steps (see steps 710, 714), the water level in main water reservoir 70*a* remains above the normal ice making level during the descaling process (see steps 710, 714). That is, when water pump 62 turns on, some of the water will be pumped from main water reservoir 70*a* and into water line 63, water distributor 66, and over freeze plate 22 resulting in a lowering of the water level in main water reservoir 70*a*. The desired descale water level may be set in two ways. First, the descale water level may be high enough to account for the slight drop in water level when water pump 62 is on and some of the volume of water is being pumped through water line 63, water distributor 66, and over freeze plate 22. Second, water pump 62 may be on when main water reservoir 70*a* is being filled with water to the descale water level and may remain on during the duration of the fill step (step 708). In this variation, by having water pump 62 on during filling, when the water level reaches the descale water level there will already be a volume of water in water line 63, water distributor 66, and over freeze plate 22. Thus, during steps 710 and 714 there will be little or no drop in the water level from the descale water level when water pump 62 is turned on or is kept on. By having the descale water level high enough to allow for the lowering of the water height while water pump 62 is on yet also allowing the water level to remain above the ice making water level, any mineral deposits above the ice making water level may be removed. While the descale water level is preferably higher than the normal ice making level, in various embodiments for example, the descale water level may be substantially the same or the same as the normal ice making level. In other embodiments, for example, the descale water level may be less than the normal ice making level.

At step 710, the water and cleaner mixture in sump 70 is circulated through water system 14 (including sump 70, water pump 62, water distributor 66, and water line 63) and freeze plate 22. This is done by controller 80 turning on water pump 62. However, in other embodiments, for example, if water pump 62 was on during the filling step (step 708), controller 80 keeps water pump 62 on. Therefore, it will be understood that in some embodiments, steps 708 and 710 may occur concurrently. Water pump 62 pumps the water and cleaner mixture from main water reservoir 70*a* of sump 70 through water line 63 to water distributor 66. The water and cleaner mixture then exits water distributor 66, cascades down freeze plate 22 and returns to main water reservoir 70*a* of sump 70. Controller 80 of ice maker 10 will continue to operate water pump 62 to recirculate the water and cleaner mixture through the water system 14 and freeze plate 22 of ice maker 10 for a desired amount of time ($t_{clean}$). The cleaning time ($t_{clean}$) may be from about 30 seconds to about 5 minutes (e.g., about 30 seconds, about 45 seconds, about 1 minute, about 1.5 minutes, about 2.0 minutes, about 2.5 minutes, about 3.0 minutes, about 3.5 minutes, about 4.0 minutes, about 4.5 minutes, about 5.0 minutes). Preferably, the cleaning time ($t_{clean}$) is about 60 seconds. In certain embodiments for example, the cleaning time ($t_{clean}$) is less than 30 seconds. In other embodiments, for example, the cleaning time ($t_{clean}$) may be greater than 5 minutes. In some embodiments, the user may cause controller 80 to vary the cleaning time ($t_{clean}$) based on the amount of mineral deposits on ice maker 10.

After the desired cleaning time ($t_{clean}$) has been reached, the water and cleaner mixture is purged from main water reservoir 70*a* of sump 70 at step 712. This is accomplished by controller 80 opening discharge valve 56 and turning on water pump 62. Water pump 62 then pumps the water and cleaner mixture and mineral deposits, debris, dirt, and/or other contaminants out of sump 70 via water discharge line 54. Controller 80 of ice maker 10 will continue to operate water pump 62 to drain the water and cleaner mixture from main water reservoir 70*a* of sump 70 until controller 80 receives an indication from sump water level sensor 84 that sump 70 is substantially or completely empty. In various embodiments, water inlet valve 54 may be opened for at least a portion of the purge cycle to supply fresh or clean water to sump 70 which may assist in purging the water and cleaner mixture from sump. Alternatively, in various embodiments, for example controller 80 of ice maker 10 may continue to operate water pump 62 to drain the water and cleaner mixture from main water reservoir 70*a* of sump 70 until a desired period of time has elapsed, wherein after that elapsed time sump 70 should be substantially or completely empty. Once sump 70 is substantially or completely empty, controller 80 turns off water pump 62 and closes discharge valve 56. In alternative embodiments, for example, sump 70 may be drained by gravity without the need of water pump 62. In such embodiments, opening discharge valve 56 allows the water and cleaner mixture to drain from sump 70 by the force of gravity.

After the water and cleaner mixture has been purged from sump 70, water system 14 and freeze plate 22 are rinsed at step 714 by pumping fresh or clean water through water system 14 and freeze plate 22. This rinsing ensures that substantially all or all of the cleaner is removed from water system 14 and freeze plate 22 prior to the sanitizing portion of the process. As described above, the cleaner and the sanitizer may create noxious and/or dangerous gases therefore, rinsing water system 14 and freeze plate 22 aids in reducing or eliminating the potential for such gases to be created during the subsequent sanitizing portion of the process.

During the rinsing step of the descale portion, controller 80 again opens water supply valve 52 to supply fresh or clean water to sump 70. Water supply valve 52 is kept open, supplying water to sump 70, until the water level in sump 70 reaches the descale water level as measured by sump water level sensor 84, as described above with respect to step 708. Once the descale water level is reached, controller 80 closes water supply valve 52. Water pump 62 pumps the fresh water from sump 70 through water line 63 to water distributor 66. The fresh water then exits water distributor 66, cascades down freeze plate 22 and returns to sump 70. Water pump 62 may be on when sump 70 is being filled with fresh or clean water to the descale water level and may remain on during the duration of the rinse step (step 714); however, in other embodiments, water pump 62 may be turned on only after sump 70 is filled. Controller 80 of ice maker 10 will continue to operate water pump 62 to recirculate the fresh water to rinse off some or all of the cleaner remaining in water system 14 and freeze plate 22 of ice maker 10 for a desired amount of time ($t_{rinse}$). The rinsing time ($t_{rinse}$) may be from about 30 seconds to about 4 minutes (e.g., about 30 seconds, about 45 seconds, about 1 minute, about 1.5 minutes, about 2.0 minutes, about 2.5 minutes, about 3 minutes, about 3.5 minutes, about 4 minutes). Preferably, the rinsing time ($t_{rinse}$) is about 2 minutes. In certain embodiments for example, the rinsing time ($t_{rinse}$) is less than 30 seconds. In other embodiments, for example, the rinsing time ($t_{rinse}$) may be greater than 4 minutes. After the rinsing time has elapsed, the fresh water and at least a portion of any cleaner remaining in water system 14 and freeze plate 22 is purged from sump 70. Like the purge described in step 712, this is accomplished by controller 80 opening discharge valve 56 and keeping on or turning on water pump 62 to pump the water out of main water reservoir 70*a* of sump 70 via water discharge line 54. The rinse portion of the process is complete when the controller 80 receives an indication from sump water level sensor 84 that sump 70 is substantially or completely empty.

The rinse step (step 714) of the descale portion of the process is preferably repeated a number of times to aid in the substantially complete or complete rinsing, washing, or removing of the cleaner from water system 14 (including sump 70, water pump 62, water distributor 66, and water line 63) and freeze plate 22. Therefore, step 714 may be repeated from about 5 to about 10 times (e.g., about 5 times, about 6 times, about 7 times, about 8 times, about 9 times, about 10 times). Preferably, step 714 is repeated about 8 times. In certain embodiments for example, step 714 is repeated less than 5 times. In other embodiments, for example, step 714 is repeated more than 10 times. To track and control the number of times that rinsing step 714 has occurred, controller 80 may include a counter that is incremented each time step 714 is completed. In other embodiments, the rinse step (step 714) of the descale portion of the process is preferably repeated a number of times based on a total rinse time ($t_{\Sigma rinse}$) instead of by a number repetitions of step 714. The rinsing time ($t_{\Sigma rinse}$) may be from about 10 minutes to about 60 minutes (e.g., about 10 minutes, about 15 minutes, about 20 minutes, about 25 minutes, about 30 minutes, about 35 minutes, about 40 minutes, about 45 minutes, about 50 minutes, about 55 minutes, about 60 minutes). Preferably, the rinsing time ($t_{\Sigma rinse}$) is about 30 minutes. In certain embodiments for example, the rinsing time ($t_{\Sigma rinse}$) is less than 10 minutes. In other embodiments, for example, the rinsing time ($t_{\Sigma rinse}$) may be greater than 60 minutes.

Figure 8:
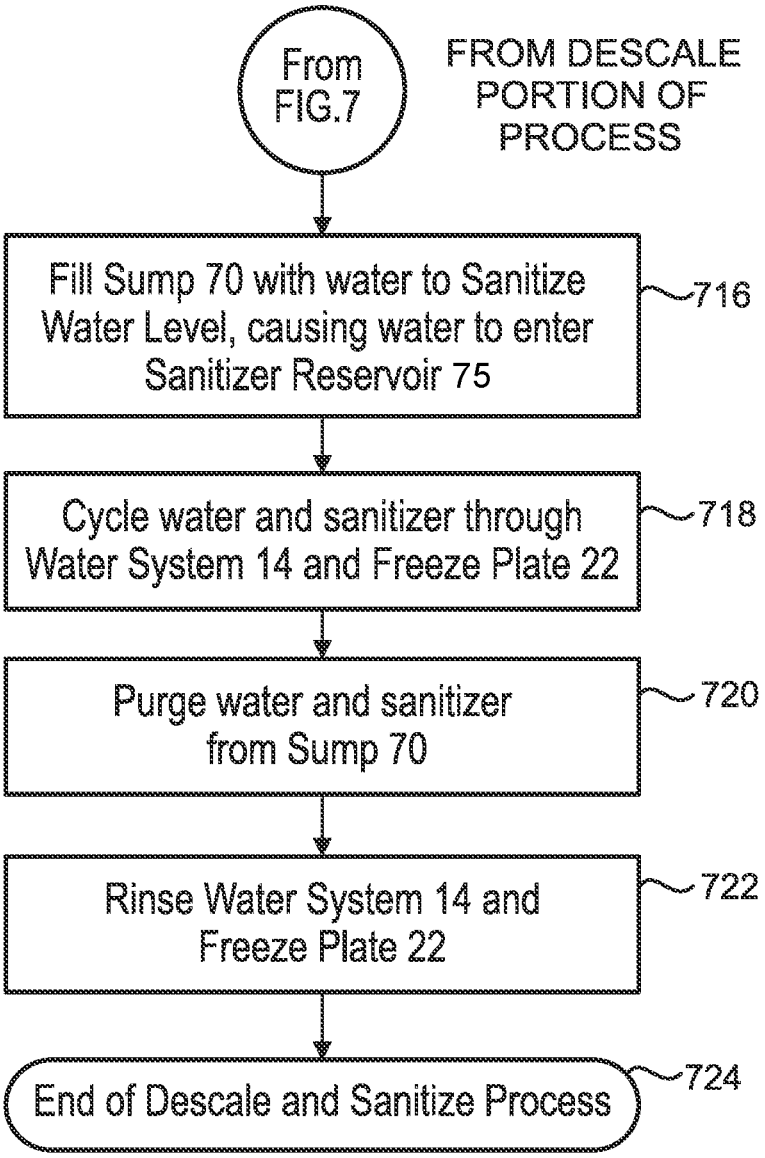
FIG. 8 is flow chart describing the sanitize portion of an automatic descale and sanitize process of an ice maker according to the first embodiment of the invention.

After the cleaner is substantially or completely rinsed from water system 14 and freeze plate 22, the descale portion of the automatic descale and sanitize process is complete. The process then continues to the sanitize portion of the process as illustrated in FIG. 8. At step 716, controller 80 opens water supply valve 52 to supply water to main water reservoir 70*a* of sump 70. Water supply valve 52 is kept open, supplying water to sump 70, until the water level in sump 70 reaches the sanitize water level as measured by sump water level sensor 84. As shown and described with respect to FIGS. 5A and 6, the sanitize water level is higher than or above the descale water level. The sanitize water level is also at a height above the bottom 72 of sump 70 such that when the water in sump 70 reaches the sanitize water level, the water enters and at least partially fills the sanitizer reservoir 75 and mixes with the sanitizer. The water and sanitizer mixture then flows from sanitizer reservoir 75 into main water reservoir 70*a* of sump 70. The sanitizer (described above) may readily dissolve in the water. Once the sanitize water level is reached, controller 80 closes water supply valve 52.

The sanitize water level is preferably high enough in main water reservoir 70*a* such that when water pump 62 turns on during subsequent steps (see steps 718, 722), water continues to enter into sanitizer reservoir 75 from main water reservoir 70*a* to aid in mixing of sanitizer in the water during the sanitizing process (see steps 718, 722). That is, when water pump 62 turns on, some of the water will be pumped from main water reservoir 70*a* and into water line 63, water distributor 66, and over freeze plate 22 resulting in a lowering of the water level in main water reservoir 70*a*. The desired sanitize water level may be set in two ways. First, the sanitize water level may be high enough to account for the slight drop in water level when water pump 62 is on and some of the volume of water is being pumped through water line 63, water distributor 66, and over freeze plate 22. Second, water pump 62 may be on when main water reservoir 70*a* is being filled with water to the sanitize water level and may remain on during the duration of the fill step (step 716). In this variation, by having water pump 62 on during filling, when the water level reaches the sanitize water level there will already be a volume of water in water line 63, water distributor 66, and over freeze plate 22. Thus, during steps 718 and 722 there will be little or no drop in the water level from the sanitize water level when water pump 62 is turned on or is kept on.

At step 718, the water and sanitizer mixture in sump 70 is circulated through water system 14 (including sump 70, water pump 62, water distributor 66, and water line 63) and freeze plate 22. This is done by controller 80 turning on water pump 62. However, in other embodiments, for example, if water pump 62 was on during the fill step (step 716), controller 80 keeps water pump 62 on. Therefore, it will be understood that in some embodiments, steps 716 and 718 may occur concurrently. Water pump 62 pumps the water and sanitizer mixture from sump 70 through water line 63 to water distributor 66. The water and cleaner mixture then exits water distributor 66, cascades down freeze plate 22 and returns to sump 70. Controller 80 of ice maker 10 will continue to operate water pump 62 to recirculate the water and sanitizer mixture through the water system 14 and freeze plate 22 of ice maker 10 for a desired amount of time ($t_{sanitize}$). During this step, bacteria, viruses, and/or other undesirable biologic material within water system 14 and freeze plate 22 are destroyed by the sanitizer in the water and sanitizer mixture. The sanitizing time ($t_{sanitize}$) may be from about 30 seconds to about 5 minutes (e.g., about 30 seconds, about 45 seconds, about 1 minute, about 1.5 minutes, about 2.0 minutes, about 2.5 minutes, about 3.0 minutes, about 3.5 minutes, about 4.0 minutes, about 4.5 minutes, about 5.0 minutes). Preferably, the sanitizing time ($t_{sanitize}$) is about 60 seconds. In certain embodiments for example, the sanitizing time ($t_{sanitize}$) is less than 30 seconds. In other embodiments, for example, the sanitizing time ($t_{sanitize}$) may be greater than 5 minutes.

After the desired sanitizing time ($t_{sanitize}$) has been reached, the water and sanitizer mixture is purged from sump 70 at step 720. This is accomplished by controller 80 opening discharge valve 56 and turning on water pump 62. Water pump 62 then pumps the water and sanitizer mixture, as well as bacteria, viruses, and/or other undesirable biologic material, out of sump 70 via water discharge line 54. Controller 80 of ice maker 10 will continue to operate water pump 62 to drain the water and cleaner mixture from sump 70 until controller 80 receives an indication from sump water level sensor 84 that sump 70 is substantially or completely empty. Alternatively, in various embodiments, for example controller 80 of ice maker 10 may continue to operate water pump 62 to drain the water and sanitizer mixture from sump 70 until a desired period of time has elapsed, wherein after that elapsed time sump 70 should be substantially or completely empty. Once sump 70 is substantially or completely empty, controller 80 turns off water pump 62 and closes discharge valve 56. In various embodiments, water inlet valve 54 may be opened for at least a portion of the purge cycle to supply fresh or clean water to sump 70 which may assist in purging the water and sanitizer mixture from sump. In alternative embodiments, for example, sump 70 may be drained by gravity without the need of water pump 62. In such embodiments, opening discharge valve 56 allows the water and sanitizer mixture to drain from sump 70 by the force of gravity.

After the water and sanitizer mixture has been purged from sump 70, water system 14 and freeze plate 22 are rinsed at step 722 by pumping fresh or clean water through water system 14 and freeze plate 22. This rinsing ensures that substantially all or all of the sanitizer is removed from water system 14 and freeze plate 22 prior to ice maker 10 resuming the making of ice. As described above, ice made by ice maker 10 is a food product; therefore, rinsing water system 14 and freeze plate 22 aids in reducing or eliminating the potential for sanitizer being frozen in any ice made after the completion of the automatic descale and sanitize process.

During the rinsing step of the sanitize portion, controller 80 again opens water supply valve 52 to supply fresh or clean water to sump 70. Water supply valve 52 is kept open, supplying water to sump 70, until the water level in sump 70 reaches the sanitize water level as measured by sump water level sensor 84, as described above with respect to step 716. Once the sanitize water level is reached, controller 80 closes water supply valve 52. Water pump 62 pumps the fresh water from sump 70 through water line 63 to water distributor 66. The fresh water then exits water distributor 66, cascades down freeze plate 22 and returns to sump 70. Water pump 62 may be on when sump 70 is being filled with fresh or clean water to the sanitize water level and may remain on during the duration of the rinse step (step 722); however, in other embodiments, water pump 62 may be turned on only after sump 70 is filled to the sanitize water level. Controller 80 of ice maker 10 will continue to operate water pump 62 to recirculate the fresh water to rinse off some or all of sanitizer remaining in water system 14 and freeze plate 22 of ice maker 10 for a desired amount of time ($t_{rinse}$). The rinsing time ($t_{rinse}$) may be from about 30 seconds to about 4 minutes (e.g., about 30 seconds, about 45 seconds, about 1 minute, about 1.5 minutes, about 2.0 minutes, about 2.5 minutes, about 3 minutes, about 3.5 minutes, about 4 minutes). Preferably, the rinsing time ($t_{rinse}$) is about 2 minutes. In certain embodiments for example, the rinsing time ($t_{rinse}$) is less than 30 seconds. In other embodiments, for example, the rinsing time ($t_{rinse}$) may be greater than 4 minutes. After the rinsing time has elapsed, the fresh water and at least a portion of any sanitizer remaining in water system 14 and freeze plate 22 is purged from sump 70. Like the purge described in step 720, this is accomplished by controller 80 opening discharge valve 56 and keeping on or turning on water pump 62 to pump the water out of sump 70 via water discharge line 54. The rinse portion of the process is complete when the controller 80 receives an indication from sump water level sensor 84 that sump 70 is substantially or completely empty.

The rinse step (step 722) of the sanitize portion of the process is preferably repeated a number of times to aid in the substantially complete or complete rinsing, washing, or removing of the cleaner from water system 14 (including sump 70, water pump 62, water distributor 66, and water line 63) and freeze plate 22. Therefore, step 722 may be repeated from about 5 to about 10 times (e.g., about 5 times, about 6 times, about 7 times, about 8 times, about 9 times, about 10 times). Preferably, step 722 is repeated about 8 times. In certain embodiments for example, step 722 is repeated less than 5 times. In other embodiments, for example, step 722 is repeated more than 10 times. To track and control the number of times that rinsing step 722 has occurred, controller 80 may include a counter that is incremented each time step 722 is completed. In other embodiments, the rinse step (step 722) of the sanitize portion of the process is preferably repeated a number of times based on a total rinse time ($t_{\Sigma rinse}$) instead of by a number repetitions of step 722. The rinsing time ($t_{\Sigma rinse}$) may be from about 10 minutes to about 60 minutes (e.g., about 10 minutes, about 15 minutes, about 20 minutes, about 25 minutes, about 30 minutes, about 35 minutes, about 40 minutes, about 45 minutes, about 50 minutes, about 55 minutes, about 60 minutes). Preferably, the rinsing time ($t_{\Sigma rinse}$) is about 30 minutes. In certain embodiments for example, the rinsing time ($t_{\Sigma rinse}$) is less than 10 minutes. In other embodiments, for example, the rinsing time ($t_{\Sigma rinse}$) may be greater than 60 minutes.

After the sanitizer is substantially or completely rinsed from water system 14 and freeze plate 22, the automatic descale and sanitize process is complete at step 724. At this point, ice maker 10 may resume normal making of ice.

Figure 9:
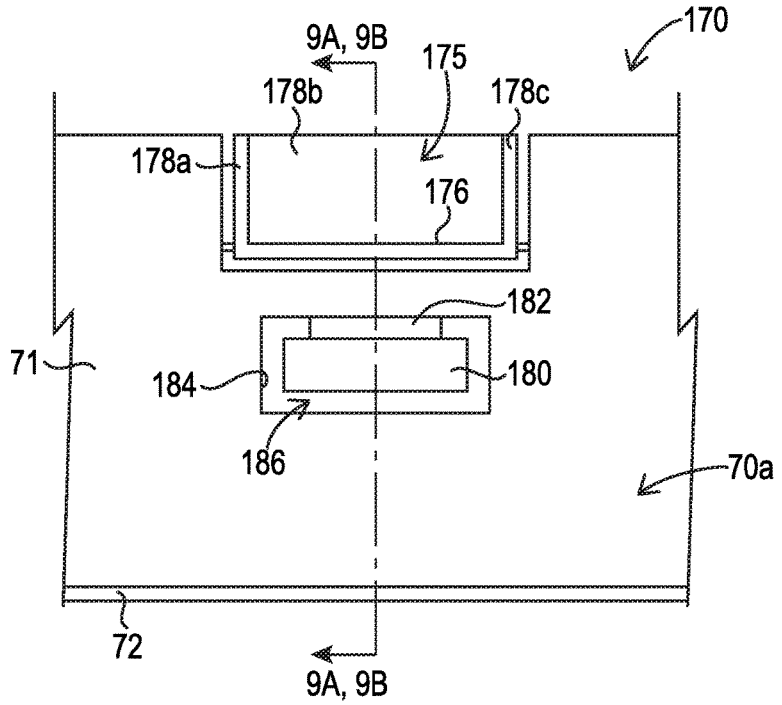
FIG. 9 is a front view of a portion of a sump according to the second embodiment of the invention.
Figure 9A:
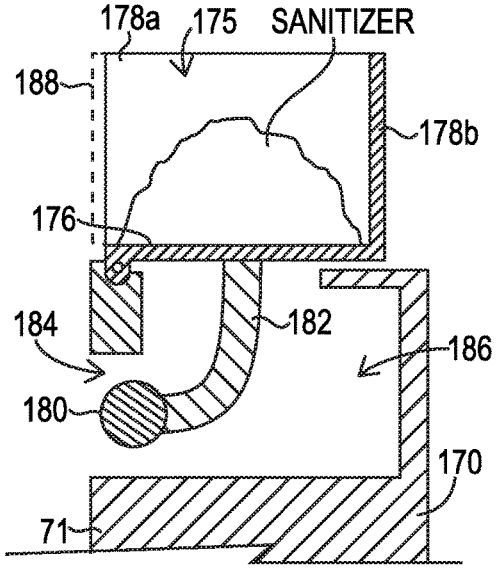
FIG. 9A is a right section view of a portion of the sump with a sanitizer reservoir in a first position when the water level in the sump is at a normal ice making water level and a descale water level according to the second embodiment of the invention.
Figure 9B:
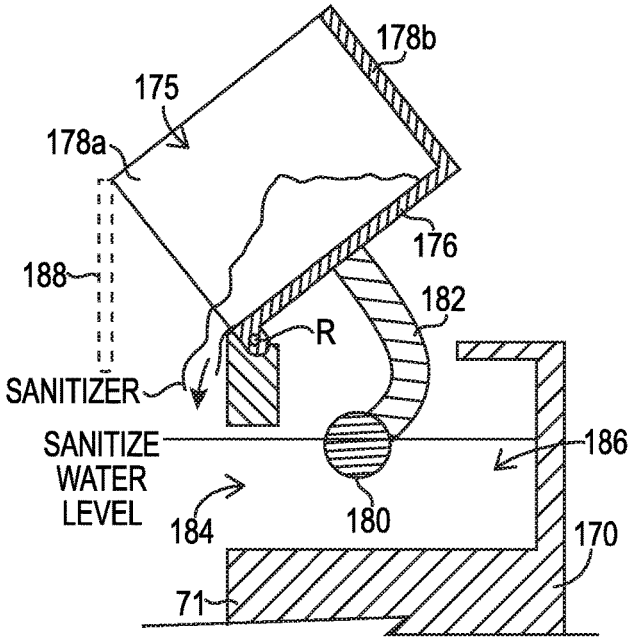
FIG. 9B is a right section view of a portion of the sump with a sanitizer reservoir in a second position when the water level in the sump is at a sanitize water level according to the second embodiment of the invention.

An alternative embodiment of a sump of the disclosure is illustrated in FIGS. 9, 9A, and 9B and is described below. Some features of one or more of sumps 70 and 170 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

With reference now to FIGS. 9, 9A, and 9B, an alternative embodiment of a sump 170 having a sanitizer reservoir 175 is described in detail. Instead of a sanitizer reservoir 75 fixed in position on sump 70, sump 170 includes sanitizer reservoir 175 that is hingedly connected to sump 170 at a height above the bottom 72 of sump 170. Sanitizer reservoir 175 is adapted to rotate and dump any sanitizer in sanitizer reservoir 175 into main water reservoir 70*a* of sump 170 when the water level reaches the sanitize water level (see FIG. 9B). Sanitizer reservoir 75 is adapted to hold a sanitizer (e.g., sanitizing powder, sanitizing tablet, sanitizing pod, etc.). Sanitizer reservoir 175 is formed by a bottom 176 and a wall 178 extending upward therefrom. Wall 178 includes left wall portion 178*a*, rear wall portion 178*b*, and right wall portion 178*c*. Sanitizer reservoir 175 further includes float 180 connected to bottom 176 by arm 182. Sump 170 further includes hole 184 in wall 71 of sump 170 which opens into chamber 186. When the water level in sump 170 reaches the sanitize water level the water enters chamber 186 via hole 184 and causes float 180 to rise. As a result of float 180 rising, sanitizer reservoir rotates about point R and dumps the sanitizer held therein into main water reservoir 70*a* of sump 170 (see FIG. 9B). Sanitizer reservoir 175 may optionally include a door 188 that is hingedly connected to sanitizer reservoir 175 that is adapted to be closed when the water in sump 170 is lower than the sanitize water level (see FIG. 9A) and is adapted to be open when the water in sump 170 is at the sanitize water level (see FIG. 9B). Door 188 may assist in reducing or preventing sanitizer from entering main water reservoir 70*a* of sump 170 prior to the sanitize portion of the process. As compared to the fixed sanitizer reservoir 75 described above, water does not enter sanitizer reservoir 75 during the automatic descale and sanitize process. This aspect may be desired if the sanitizer used tends to clump or stick to surfaces when the sanitizer gets wet.

Figure 10:
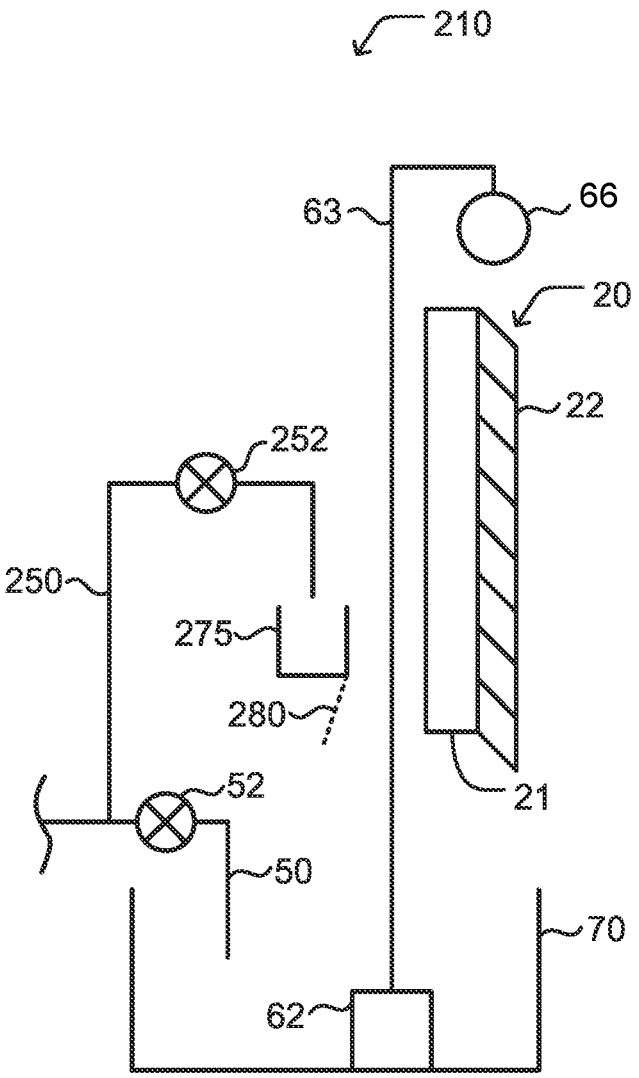
FIG. 10 is a schematic drawing of an ice maker having various components according to a third embodiment of the invention.
Figure 11:
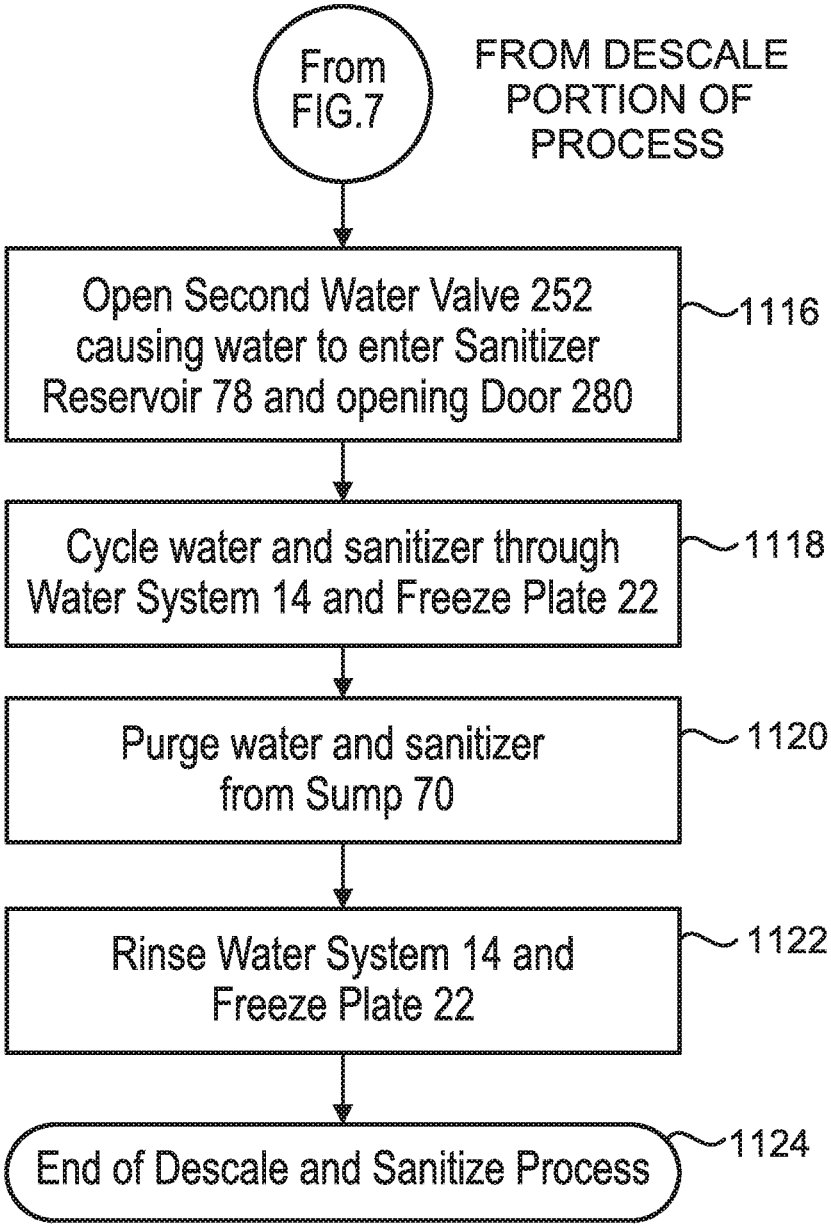
FIG. 11 is flow chart describing the sanitize portion of an automatic descale and sanitize process of an ice maker according to the third embodiment of the invention.

An alternative embodiment of an ice maker of the disclosure is illustrated in FIGS. 10 and 11 and is described below. Some features one or more of ice makers 10 and 210 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

With reference now to FIG. 10, an alternative embodiment of an ice maker 210 having a sanitizer reservoir 275 is described in detail. FIG. 10 schematically represents only a portion of ice maker 210 and certain components of ice maker 210 common with ice maker 10 are not shown for clarity purposes. In addition to water inlet valve 52 and water supply line 50, ice maker 210 includes a second water inlet valve 252 in fluid communication with sanitize water supply line 250. Sanitize water supply line 250 is shown a teeing off of water supply line 50. Ice maker 210 additionally includes sanitizer reservoir 275 in which a sanitizer may be placed formed by a bottom and a wall extending upward therefrom. Therefore, sanitizer reservoir 275 is adapted to hold a sanitizer (e.g., sanitizing powder, sanitizing liquid, sanitizing tablet, sanitizing pod, etc.). The bottom of sanitizer reservoir 275 includes optional door 280 which may be spring loaded and normally biased in the closed position. When second water inlet valve 252 is opened, the force of the water coming out of sanitize water supply line 250 causes door 280 to swing downward (as shown in dashed lines) and the sanitizer in sanitizer reservoir will fall into sump 70.

Figure 7:
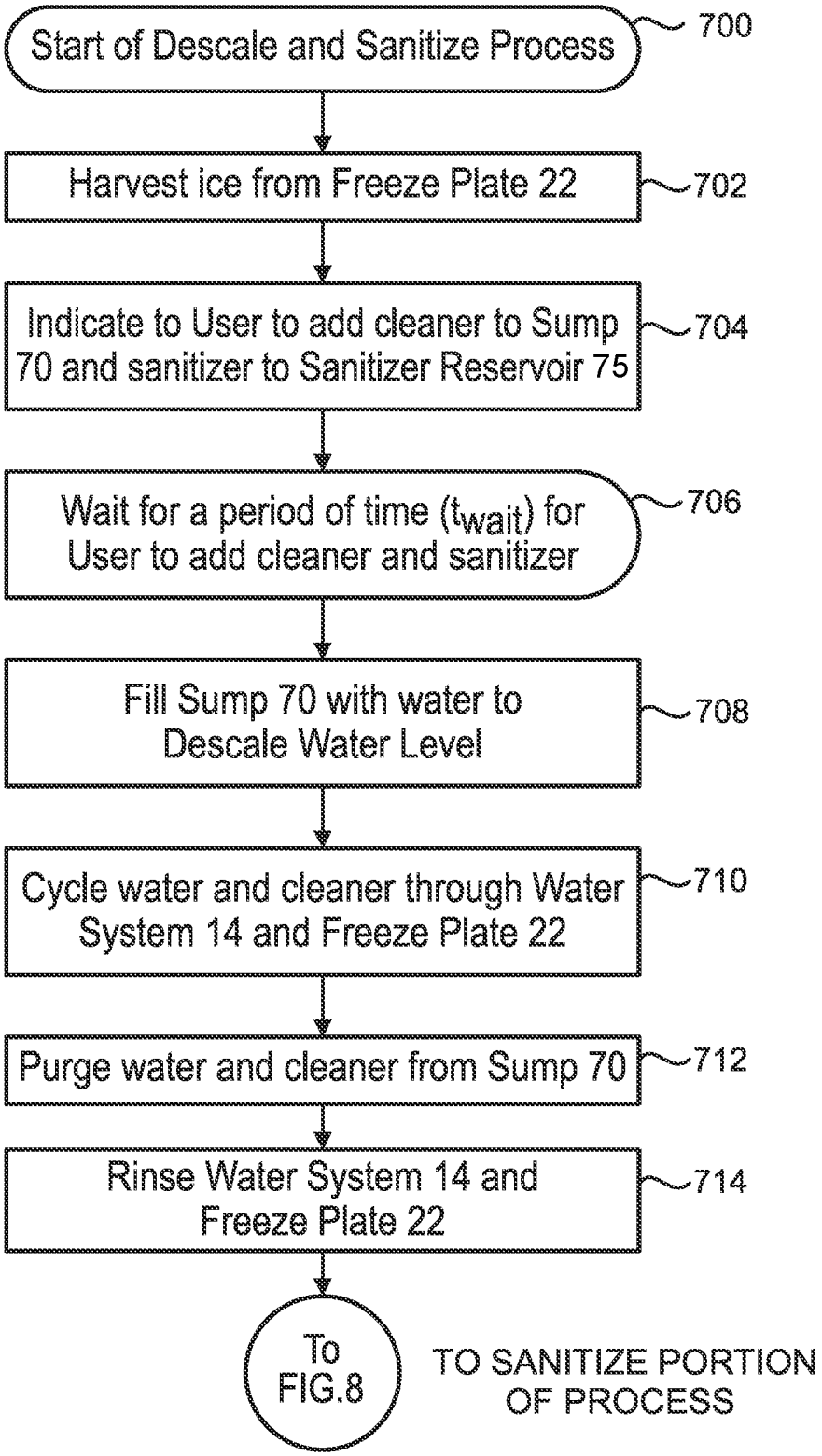
FIG. 7 is flow chart describing the descale portion of an automatic descale and sanitize process of an ice maker according to the first embodiment of the invention.

The descale portion of the automatic descale and sanitize process of ice maker 210 is the same as the descale portion of the automatic descale and sanitize process of ice maker 10 as described in steps 700-714 in FIG. 7. However, the sanitize portion of the automatic descale and sanitize process of ice maker 210 differs and is described with respect to FIG. 11.

Following steps 700-714 described in FIG. 7, the sanitize portion of automatic descale and sanitize process of ice maker 210 continues as illustrated in FIG. 11. At step 1116, controller 80 opens second water supply valve 252. The water exiting sanitize water supply line enters sanitizer reservoir 275, begins to mix with the sanitizer previously placed therein, and causes door 280 to swing downward. Water and sanitizer will then fall into sump 70 and will begin to fill sump 70. Second water supply valve 52 is kept open, supplying water to sump 70, until the water level in sump 70 at least reaches the descale water level as measured by sump water level sensor 84. Because of the alternative construction, function, and placement of sanitizer reservoir 275 as compared to sanitizer reservoirs 75 and 175, the water level is not required to be at a level higher than or above the descale water level. However, it will be understood that in some embodiments, sump 70 may be filled to a higher water level than the descale water level. The sanitizer (described above) may readily dissolve in the water. Once at least the descale water level is reached, controller 80 closes water supply valve 52.

At step 1118, the water and sanitizer mixture in sump 70 is circulated through water system 14 (including sump 70, water pump 62, water distributor 66, and water line 63) and freeze plate 22. This is done by controller 80 turning on water pump 62. Water pump 62 pumps the water and sanitizer mixture from sump 70 through water line 63 to water distributor 66. The water and cleaner mixture then exits water distributor 66, cascades down freeze plate 22 and returns to sump 70. Controller 80 of ice maker 10 will continue to operate water pump 62 to recirculate the water and sanitizer mixture through the water system 14 and freeze plate 22 of ice maker 10 for a desired amount of time ($t_{sanitize}$). During this step, bacteria, viruses, and/or other undesirable biologic material within water system 14 and freeze plate 22 are destroyed by the sanitizer in the water and sanitizer mixture. The sanitizing time ($t_{sanitize}$) may be from about 30 seconds to about 5 minutes (e.g., about 30 seconds, about 45 seconds, about 1 minute, about 1.5 minutes, about 2.0 minutes, about 2.5 minutes, about 3.0 minutes, about 3.5 minutes, about 4.0 minutes, about 4.5 minutes, about 5.0 minutes). Preferably, the sanitizing time ($t_{sanitize}$) is about 60 seconds. In certain embodiments for example, the sanitizing time ($t_{sanitize}$) is less than 30 seconds. In other embodiments, for example, the sanitizing time ($t_{sanitize}$) may be greater than 5 minutes. In some embodiments, the user may cause controller 80 to vary the sanitizing time ($t_{sanitize}$) based on the amount of mineral deposits on ice maker 10.

After the desired sanitizing time ($t_{sanitize}$) has been reached, the water and sanitizer mixture is purged from sump 70 at step 1120. This is accomplished by controller 80 opening discharge valve 56 and turning on water pump 62. Water pump 62 then pumps the water and sanitizer mixture, as well as bacteria, viruses, and/or other undesirable biologic material, out of sump 70 via water discharge line 54. Controller 80 of ice maker 210 will continue to operate water pump 62 to drain the water and cleaner mixture from sump 70 until controller 80 receives an indication from sump water level sensor 84 that sump 70 is substantially or completely empty. Alternatively, in various embodiments, for example controller 80 of ice maker 210 may continue to operate water pump 62 to drain the water and sanitizer mixture from sump 70 until a desired period of time has elapsed, wherein after that elapsed time sump 70 should be substantially or completely empty. Once sump 70 is substantially or completely empty, controller 80 turns off water pump 62 and closes discharge valve 56. In various embodiments, water inlet valve 54 may be opened for at least a portion of the purge cycle to supply fresh or clean water to sump 70 which may assist in purging the water and sanitizer mixture from sump. In alternative embodiments, for example, sump 70 may be drained by gravity without the need of water pump 62. In such embodiments, opening discharge valve 56 allows the water and sanitizer mixture to drain from sump 70 by the force of gravity.

After the water and sanitizer mixture has been purged from sump 70, water system 14 and freeze plate 22 are rinsed at step 1122 by pumping fresh or clean water through water system 14 and freeze plate 22. This rinsing ensures that substantially all or all of the sanitizer is removed from water system 14 and freeze plate 22 prior to ice maker 10 resuming the making of ice. As described above ice made by ice maker 10 is a food product; therefore, rinsing water system 14 and freeze plate 22 aids in reducing or eliminating the potential for sanitizer being frozen in any ice made after the completion of the automatic descale and sanitize process.

During the rinsing step of the sanitize portion, controller 80 again opens second water supply valve 252 to rinse sanitizer reservoir 275 and to supply fresh water to sump 70. Water supply valve 52 is kept open, rinsing sanitizer reservoir 275 and supplying water to sump 70, until the water level in sump 70 reaches at least the descale water level as measured by sump water level sensor 84. Once the sanitize water level is reached, controller 80 closes water supply valve 52. Water pump 62 pumps the fresh water from sump 70 through water line 63 to water distributor 66. The fresh water then exits water distributor 66, cascades down freeze plate 22 and returns to sump 70. Water pump 62 may be on when sump 70 is being filled with fresh or clean water to the sanitize water level and may remain on during the duration of the rinse step (step 1122); however, in other embodiments, water pump 62 may be turned on only after sump 70 is filled to the sanitize water level. Controller 80 of ice maker 210 will continue to operate water pump 62 to recirculate the fresh water to rinse off some or all of sanitizer remaining in sanitizer reservoir 275, water system 14, and freeze plate 22 of ice maker 210 for a desired amount of time ($t_{rinse}$). The rinsing time ($t_{rinse}$) may be from about 30 seconds to about 4 minutes (e.g., about 30 seconds, about 45 seconds, about 1 minute, about 1.5 minutes, about 2.0 minutes, about 2.5 minutes, about 3 minutes, about 3.5 minutes, about 4 minutes). Preferably, the rinsing time ($t_{rinse}$) is about 2 minutes. In certain embodiments for example, the rinsing time ($t_{rinse}$) is less than 30 seconds. In other embodiments, for example, the rinsing time ($t_{rinse}$) may be greater than 4 minutes. After the rinsing time has elapsed, the fresh water and at least a portion of any sanitizer remaining in sanitizer reservoir 210, water system 14, and freeze plate 22 is purged from sump 70. Like the purge described in step 1120, this is accomplished by controller 80 opening discharge valve 56 and keeping on or turning on water pump 62 to pump the fresh water out of sump 70 via water discharge line 54. The rinse portion of the process is complete when the controller 80 receives an indication from sump water level sensor 84 that sump 70 is substantially or completely empty.

The rinse step (step 1122) of the sanitize portion of the process is preferably repeated a number of times to aid in the substantially complete or complete rinsing, washing, or removing of the cleaner from sanitizer reservoir 275, water system 14 (including sump 70, water pump 62, water distributor 66, and water line 63) and freeze plate 22. Therefore, step 1122 may be repeated from about 5 to about 10 times (e.g., about 5 times, about 6 times, about 7 times, about 8 times, about 9 times, about 10 times). Preferably, step 1122 is repeated about 8 times. In certain embodiments for example, step 1122 is repeated less than 5 times. In other embodiments, for example, step 1122 is repeated more than 10 times. To track and control the number of times that rinsing step 1122 has occurred, controller 80 may include a counter that is incremented each time step 1122 is completed. In other embodiments, the rinse step (step 1122) of the sanitize portion of the process is preferably repeated a number of times based on a total rinse time ($t_{\Sigma rinse}$) instead of by a number repetitions of step 1122. The rinsing time ($t_{\Sigma rinse}$) may be from about 10 minute to about 60 minutes (e.g., about 10 minutes, about 15 minutes, about 20 minutes, about 25 minutes, about 30 minutes, about 35 minutes, about 40 minutes, about 45 minutes, about 50 minutes, about 55 minutes, about 60 minutes). Preferably, the rinsing time ($t_{\Sigma rinse}$) is about 30 minutes. In certain embodiments for example, the rinsing time ($t_{\Sigma rinse}$) is less than 10 minutes. In other embodiments, for example, the rinsing time ($t_{\Sigma rinse}$) may be greater than 60 minutes.

After the sanitizer is substantially or completely rinsed from sanitizer reservoir 275, water system 14 and freeze plate 22, the automatic descale and sanitize process is complete at step 1124. At this point, ice maker 210 may resume normal making of ice.

Figure 12:
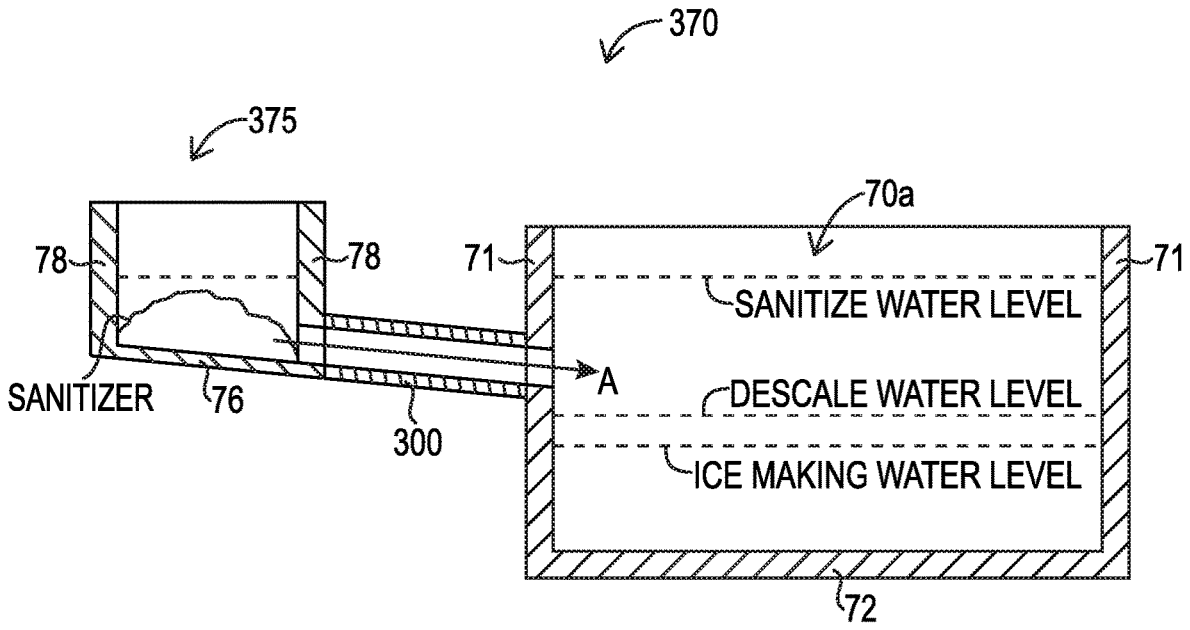
FIG. 12 is a section view of a sump according to a fourth embodiment of the invention.

Yet an alternative embodiment of a sump of the disclosure is illustrated in FIG. 12 and is described below. Some features of one or more of sumps 70 and 370 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

With reference now to FIG. 12, an alternative embodiment of a sump 370 having a remote sanitizer reservoir 375 is described in detail. Sump 370 comprises a main water reservoir **70*a* for holding water and a remote sanitizer reservoir 375 for holding a sanitizer. Placing sanitizer reservoir 375 remote from main water reservoir 70*a*** of sump 370 may aid in accessibility of sanitizer reservoir 375 without interfering with ice dropping from freeze plate 22 and may also permit main water reservoir 70*a* of sump 370 to be narrower. The width of the sump in narrow ice makers (e.g., 22" wide ice makers) is critical in achieving the target width of the unit, therefore remote sanitizer reservoir 375 may allow achieving this goal.

Main water reservoir 70*a* is formed by a bottom 72 and a wall 71 extending upward therefrom. Sanitizer reservoir 375 is formed by a bottom 76 and a wall 78 extending upward therefrom. Sanitizer reservoir 375 is adapted to hold a sanitizer (e.g., sanitizing powder, sanitizing tablet, sanitizing pod, etc.). Sanitizer reservoir 375 is in fluid communication with main water reservoir 70*a* by tube 300. When the water level in main sanitizer rises toward the sanitize water level, the water enters tube 300 and begins to fill sanitizer reservoir 375. When the water reaches the sanitize water level substantially all or all of sanitizer in sanitizer reservoir 375 may be submerged in water. When water pump 62 is turned on as described in step 718 (see FIG. 8), the water level in sump 370 will begin to drop as water is being pumped through the water system 14. This will tend to draw the sanitizer from sanitizer reservoir 375 into main the main water reservoir 70*a* along arrow A. As shown, bottom 76 of sanitizer reservoir 375 may be sloped toward main water reservoir 70*a* to aid in the transfer of sanitizer from sanitizer reservoir 375 to main water reservoir 70*a*.

While various steps of several methods are described herein in one order, it will be understood that other embodiments of the methods can be carried out in any order and/or without all of the described steps without departing from the scope of the invention.

Thus, there has been shown and described novel methods and apparatuses of an ice maker having an automatic descale and sanitize process. It will be apparent, however, to those familiar in the art, that many changes, variations, modifications, and other uses and applications for the subject devices and methods are possible. All such changes, variations, modifications, and other uses and applications that do not depart from the spirit and scope of the invention are deemed to be covered by the invention which is limited only by the claims which follow.

What is claimed:

1. A sump for an ice maker, the sump comprising:

a main water reservoir comprising a main reservoir bottom and a main reservoir wall extending from the main reservoir bottom, wherein the main water reservoir is adapted to be filled with water to an ice making water level, a descale water level, and a sanitize water level above the ice making level; and a sanitizer reservoir for holding a sanitizer, the sanitizer reservoir comprising a sanitizer reservoir bottom and a sanitizer reservoir wall extending from the sanitizer reservoir bottom, wherein the sanitizer reservoir is in fluid communication with the main water reservoir, and wherein the sanitizer reservoir bottom is at a height above the main reservoir bottom such that when the main water reservoir is filled to the sanitize water level, water enters the sanitizer reservoir and the sanitizer therein enters into the main water reservoir.

2. The sump of claim 1, wherein the sanitizer reservoir is integrally formed with the main reservoir wall.

3. The sump of claim 1, wherein the sanitizer reservoir and the main water reservoir are in fluid communication by a tube.

4. The sump of claim 1, wherein the descale water level is above the ice making level.

5. A sump for an ice maker, the sump comprising:

a main water reservoir comprising a main reservoir bottom and a main reservoir wall extending from the main reservoir bottom, wherein the main water reservoir is adapted to be filled with water to an ice making water level, a descale water level, and a sanitize water level above the ice making level; and a sanitizer reservoir hingedly connected to the first wall for holding a sanitizer, the sanitizer reservoir comprising a sanitizer reservoir bottom and a sanitizer reservoir wall extending from the sanitizer reservoir bottom, wherein the sanitizer reservoir further comprises a float;

wherein the sanitizer reservoir bottom is at a height above the main reservoir bottom such that when the sump is filled to the sanitize water level, water causes the float to rise causing the sanitizer reservoir to rotate and dump the sanitizer therein into the main water reservoir.

6. An ice maker for forming ice, the ice maker comprising:

(i) a refrigeration system comprising a compressor, a condenser, an evaporator, and a freeze plate thermally coupled to the evaporator, wherein the compressor, condenser and evaporator are in fluid communication by one or more refrigerant lines;

(ii) a water system for supplying water to the freeze plate, the water system comprising a sump having a main water reservoir below the freeze plate, a water distributor above the freeze plate, a sanitizer reservoir above the sump for holding a sanitizer, the sanitizer reservoir comprising a bottom and a wall extending from the bottom, wherein the sanitizer reservoir comprises a spring loaded door that is normally in the closed position, and a water pump, wherein the water pump is in fluid communication with the water distributor by a water line, the water system further comprising a first water inlet valve adapted to supply water to the main water reservoir and a second water inlet valve adapted to supply water to the sanitizer reservoir;

(iii) a water level sensor adapted to determine the water level in the main water reservoir; and (iv) a controller adapted to control the ice maker in response to the water level in the main water reservoir measured by the water level sensor, wherein the controller is adapted to:

(a) open the first water inlet valve to fill the main water reservoir with water to an ice making water level during an ice making cycle;

(b) open the first water inlet valve to fill the main water reservoir with water to a descale water level during a descale portion of a descale and sanitize process; and (c) open the second water inlet valve to fill the sanitizer reservoir with water causing the door of the sanitizer reservoir to open and deposit any sanitizer therein into the main water reservoir during a sanitize portion of the descale and sanitize process.

7. A method of descaling and sanitizing an ice maker, the ice maker comprising (i) a refrigeration system comprising a compressor, a condenser, an evaporator, and a freeze plate thermally coupled to the evaporator, wherein the compressor, condenser and evaporator are in fluid communication by one or more refrigerant lines; (ii) a water system for supplying water to the freeze plate, the water system comprising a sump having a main water reservoir below the freeze plate, a water distributor above the freeze plate, a sanitizer reservoir above the sump for holding a sanitizer, the sanitizer reservoir formed by a bottom and a wall extending from the bottom, wherein the sanitizer reservoir comprises a spring loaded door that is normally in the closed position, and a water pump, wherein the water pump is in fluid communication with the water distributor by a water line, the water system further comprising a first water inlet valve adapted to supply water to the main water reservoir and a second water inlet valve adapted to supply water to the sanitizer reservoir, the method comprising:

(i) filling the main water reservoir of the sump with first water to a descale water level using the first water inlet valve, wherein the first water mixes with a cleaner placed in the main water reservoir;

(ii) pumping the first water and cleaner mixture from the sump through the water system and over the freeze plate to descale the water system and the freeze plate;

(iii) purging the first water and cleaner mixture from the sump;

(iv) rinsing the water system and freeze plate of remaining cleaner by filling the main water reservoir with second water to the descale water level using the first water inlet valve, pumping the second water from the sump through the water system and over the freeze plate, and purging the second water and remaining cleaner from the sump;

(v) filling the sanitizer reservoir with third water using the second water inlet valve such that the third water causes the door of the sanitizer reservoir to open and deposit any sanitizer therein into the main water reservoir with the third water to form a third water and sanitizer mixture that fills the main water reservoir to at least the descale water level;

(vi) pumping the third water and sanitizer mixture from the sump through the water system and over the freeze plate to sanitize the water system and the freeze plate;

(vii) purging the third water and sanitizer mixture from the sump;

(viii) rinsing the water system and freeze plate of remaining sanitizer by filling the main water reservoir with fourth water to at least the descale water level, pumping the fourth water from the sump through the water system and over the freeze plate, and purging the fourth water and remaining sanitizer from the sump.

8. The method claim 7, further comprising harvesting ice from the freeze plate before filling the main water reservoir with the first water.

9. The method of claim 7, further comprising indicating to a user to add a cleaner to the main water reservoir of the sump and sanitizer to the sanitizer reservoir before filling the main water reservoir with the first water.

10. The method of claim 7, wherein the ice maker further comprises a water level sensor adapted to determine the water level in the sump, and a controller adapted to control the ice maker in response to the water level in the sump measured by the water level sensor.

11. The method of claim 7, wherein the step of pumping the first water and cleaner mixture from the sump through the water system and over the freeze plate to descale the water system and the freeze plate is repeated for a period of time before the step of purging the first water and cleaner mixture from the sump.

12. The method of claim 11, wherein the period of time is from 30 seconds to 5 minutes.

13. The method of claim 7, wherein the step of rinsing the water system and freeze plate of remaining cleaner is repeated a number of times before the step of filling the main water reservoir of the sump with the third water to a sanitize water level.

14. The method as of claim 7, wherein the step of rinsing the water system and freeze plate of remaining cleaner is repeated from 5 to 10 times before the step of filling the main water reservoir of the sump with the third water to a sanitize water level.

15. The method of claim 7, wherein the step of rinsing the water system and freeze plate of remaining cleaner is repeated 8 times before the step of filling the main water reservoir of the sump with the third water to a sanitize water level.

16. The method of claim 7, wherein the step of pumping the third water and sanitizer mixture from the sump through the water system and over the freeze plate to sanitize the water system and the freeze plate is repeated for a period of time before the step of purging the third water and sanitizer mixture from the sump.

17. The method of claim 16, wherein the period of time is from 30 seconds to 5 minutes.

18. The method of claim 7, wherein the step of rinsing the water system and freeze plate of remaining sanitizer is repeated a number of times.

19. The method of claim 7, wherein the step of rinsing the water system and freeze plate of remaining sanitizer is repeated from 5 to 10 times.

20. The method as of claim 7, wherein the step of rinsing the water system and freeze plate of remaining sanitizer is repeated 8 times.

21. The method of claim 7, wherein the descale water level is above the ice making level.

* * * * *